US005887236A

United States Patent [19]

Hirao et al.

[11] Patent Number: 5,887,236

[45] Date of Patent: Mar. 23, 1999

[54] IMAGE FORMING APPARATUS

[75] Inventors: Naoto Hirao; Yoshihiro Tonomoto; Toshimasa Toyama; Masaaki Ohyama; Mituaki Ono, all of Kawasaki; Kiyoshi Chinzei; Katsumi Adachi, both of Hyogo, all of Japan

[73] Assignee: Fujitsu Limited, Kawasaki, Japan

[21] Appl. No.: 932,822

[22] Filed: Sep. 18, 1997

[30] Foreign Application Priority Data

Mar. 19, 1997 [JP] Japan ..... 9-066910

[51] Int. Cl.[6] ..... G03G 15/20

[52] U.S. Cl. ..... 399/330; 399/328; 399/341

[58] Field of Search ..... 399/328, 330, 399/331, 341, 406; 219/216

[56] References Cited

U.S. PATENT DOCUMENTS

| | | | |
|---|---|---|---|
| 4,455,079 | 6/1984 | Miwa et al. | 399/308 |
| 4,753,543 | 6/1988 | Mochimaru et al. | 400/703 |
| 4,755,849 | 7/1988 | Tarumi et al. | 219/216 X |
| 4,949,132 | 8/1990 | Chimoto | 219/216 X |
| 5,017,970 | 5/1991 | Sakata | 399/67 |
| 5,070,373 | 12/1991 | Fukano et al. | 399/322 |
| 5,345,300 | 9/1994 | Uehara et al. | 399/329 |
| 5,359,401 | 10/1994 | Uehara et al. | 399/67 |
| 5,485,260 | 1/1996 | Mitsuya | 399/330 |
| 5,614,999 | 3/1997 | Kanesawa et al. | 219/216 X |
| 5,621,512 | 4/1997 | Uehara et al. | 399/328 |
| 5,623,331 | 4/1997 | Kaneko et al. | 399/328 |
| 5,666,624 | 9/1997 | Kanesawa et al. | 219/216 X |

FOREIGN PATENT DOCUMENTS

| | | |
|---|---|---|
| 54-143145 | 11/1979 | Japan . |
| 55-29822 | 3/1980 | Japan . |
| 64-9483 | 1/1989 | Japan . |
| 1-107285 | 4/1989 | Japan . |
| 4-86879 | 3/1992 | Japan . |
| 5-104706 | 4/1993 | Japan . |
| 6-274056 | 9/1994 | Japan . |
| 7-028353 | 1/1995 | Japan . |
| 7-36301 | 2/1995 | Japan . |
| 7-287462 | 10/1995 | Japan . |

*Primary Examiner*—Matthew S. Smith
*Attorney, Agent, or Firm*—Armstrong, Westerman, Hattori, McLeland & Naughton

[57] ABSTRACT

An image forming apparatus includes a fixing unit including at least a pair of rollers which thermally fix a toner image formed on a surface of a recording medium by pressing against the recording medium, and a separating and contacting mechanism supporting the pair of rollers so that the rollers can separate from and make contact with the recording medium, where the separating and contacting mechanism controls the rollers when contacting the rollers to the recording medium, by contacting each of the rollers approximately perpendicularly to the surface of the recording medium and so that the recording medium thereafter makes contact with a surface of each of the rollers for a wrap-around angle greater than 0°.

14 Claims, 20 Drawing Sheets

IMAGE FORMING APPARATUS

BACKGROUND OF THE INVENTION

The present invention generally relates to image forming apparatuses, and more particularly to an image forming apparatus which is provided with a a fixing unit which fixes a toner image which is transferred onto a recording medium such as a continuous recording paper using the electrophotography technique.

Conventionally, in a printer which uses the electrophotography technique and records the image on a continuous recording paper, if one print operation (job) ends and a next job does not occur for a predetermined time, a portion of the paper printed with the last line remains within a paper transport path within the printer. Accordingly, the recording paper is fed forward manually or automatically so as to eject the portion of the paper printed with the last line outside the printer, so that the recording paper can be cut along a perforation provided subsequent to the portion of the paper printed with the last line.

However, when the next job is started in this state, the printing is started in a state where the amount of recording paper which is fed forward to remove the print result of the previous job precedes the first line of this next job. As a result, the amount of the recording paper which is fed forward is wasted, and the utilization efficiency of the recording paper is poor.

Accordingly, a so-called back-feed is conventionally carried out if one job ends and the next job does not occur for a predetermined time. This back-feed feeds the recording paper forward if one job ends but the next job does not occur for the predetermined time, and returns the recording paper by a predetermined amount before the next job starts. As a result, the utilization efficiency of the recording paper is improved. A photoconductive body of a process unit and the recording paper are separated from each other and rollers of a fixing unit and the recording paper are separated from each other when carrying out the back-feed.

Similarly, in the case of the printer which successively records images by the first and second process units, for example, the last line that is recorded is located on a downstream side of the second process unit in a transport direction of the recording paper at a point in time when one job ends. Hence, if the next job starts in this state, the portion of the paper between the first and second process units is wasted. For this reason, a method has been proposed to also carry out the back-feed described above in such a case.

However, in the case of the printer which successively records the images by the first and second process units, if a single fixing unit is used to simplify the printer construction, this fixing unit is provided on the downstream side of the second process unit which is provided on the most downstream side along the transport direction of the recording paper. Consequently, when the above described back-feed is carried out, the image recorded on the recording paper by the previous job is not yet fixed. Therefore, when the rollers of the fixing unit and the recording paper make contact at the start of the next job, there was a problem in that the image which is not yet fixed may be disturbed by the shock of the contact between the rollers of the fixing unit and the recording paper. If the image which is not yet fixed is disturbed, the image recording quality greatly deteriorates and it becomes necessary to carry out the two jobs over again, thereby introducing another problem in that the performance of the printer greatly deteriorates. Furthermore, the disturbance of the image which is not yet fixed caused by the shock upon contact between the rollers of the fixing unit and the recording paper is particularly conspicuous when the recording medium is wrapped around the rollers of the fixing unit for a certain wrap-around angle.

SUMMARY OF THE INVENTION

Accordingly, it is a general object of the present invention to provide a novel and useful image forming apparatus in which the problems described above are eliminated.

Another and more specific object of the present invention to provide an image forming apparatus which can record an image of a high quality by preventing a toner image which is not yet fixed from becoming disturbed at the time of the fixing.

Still another object of the present invention is to provide an image forming apparatus comprising a fixing unit including at least a pair of rollers which thermally fix a toner image formed on a surface of a recording medium by pressing against the recording medium, and a separating and contacting mechanism supporting said pair of rollers so that the rollers can separate from and make contact with the recording medium, said separating and contacting mechanism controlling the rollers when contacting the rollers to the recording medium, by contacting each of the rollers approximately perpendicularly to the surface of the recording medium and so that the recording medium thereafter makes contact with a surface of each of the rollers for a wrap-around angle greater than 0°. According to the image forming apparatus of the present invention, it is possible to prevent the toner image from being disturbed when the rollers of the fixing unit makes contact with the recording medium, by preventing the surface of the recording medium from being rubbed.

Other objects and further features of the present invention will be apparent from the following detailed description when read in conjunction with the accompanying drawings.

DESCRIPTION OF THE PREFERRED EMBODIMENTS

Figure 1:
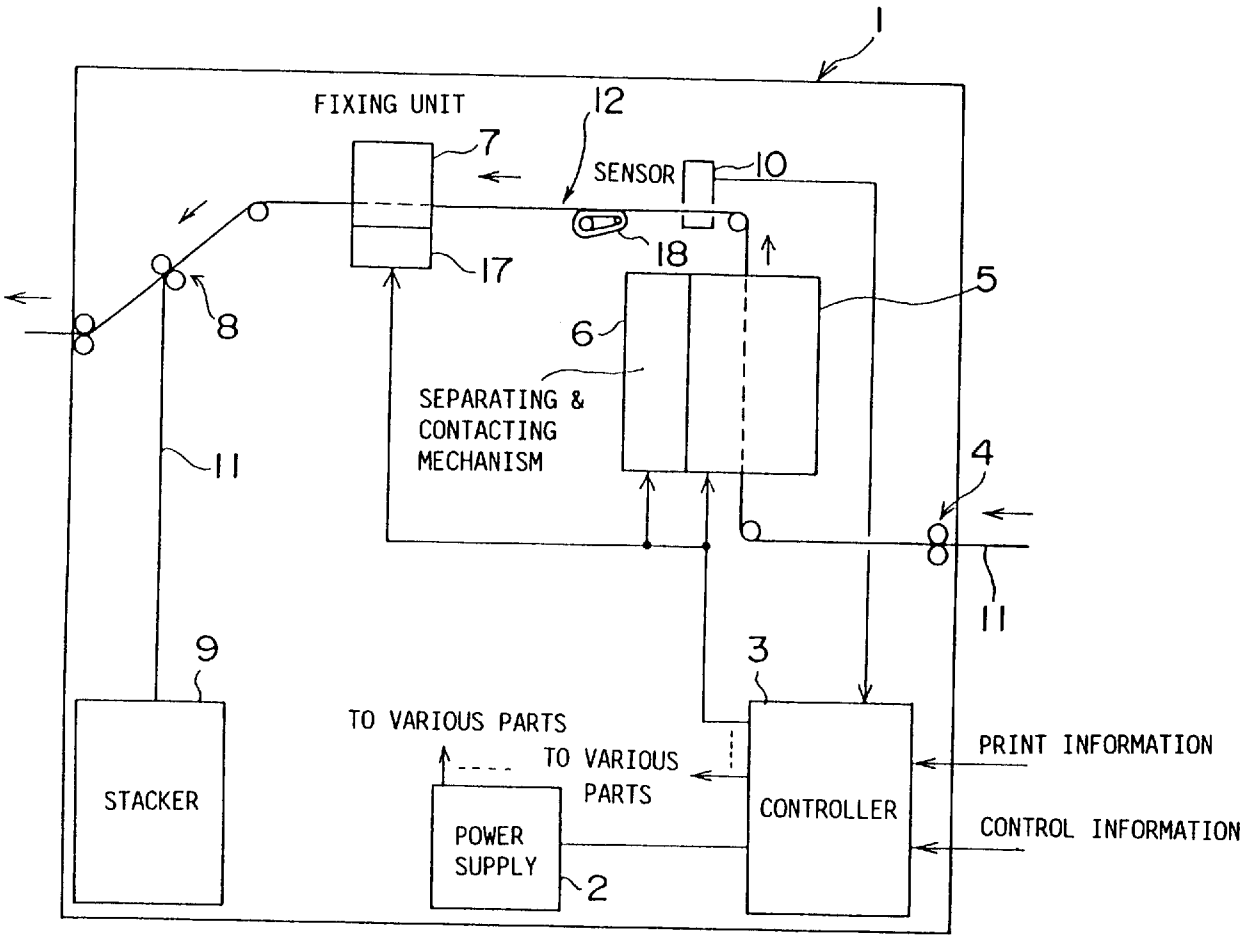
FIG. 1 is a diagram showing the general construction of a first embodiment of an image forming apparatus according to the present invention.

FIG. 1 is a diagram showing the general construction of a first embodiment of an image forming apparatus according to the present invention. In this embodiment, the present invention is applied to a printer using the electrophotography technique.

A printer 1 shown in FIG. 1 generally includes a power supply 2, a controller 3, a paper supply part 4, a process part 5, a first separating and contacting mechanism 6, a fixing unit 7, a second separating and contacting mechanism 17, a paper separating part 8, a stacker 9, a sensor 10, and a transport tractor 18. The controller 3 includes a central processing unit (CPU) or the like which controls the entire print operation of the printer 1 by controlling the operations of the various parts within the printer 1 such as the paper supply part 4, the process part 5, the first and second separating and contacting mechanisms 6 and 17, the fixing unit 7, the paper separating part 8, and the transport tractor 18, and a memory or the like which stores data and programs to be executed by the CPU. The paper supply part 4 receives a continuous recording paper 11 as a recording medium from a pre-processing mechanism (not shown) and supplies the recording paper 11 into the printer 1 by a known means. The pre-processing mechanism may be a so-called hopper, and this hopper may be provided within the printer 1. The recording paper 11 supplied into the printer 1 is transported by a known transport means (not shown) including the transport tractor 18 in a transport direction indicated by arrows in FIG. 1 along a predetermined transport path 12 within the printer 1. As will be described later, it is not essential to provide the sensor 10.

The process part 5 includes one or a plurality of process units which transfer images onto the recording paper 11 using the electrophotography technique under the control of the controller 3. The first separating and contacting mechanism 6 includes a solenoid, an air pump or the like, and controls at least one of the recording paper 11 and each of the process units to a separated state where the recording paper 11 and the process unit are separated from each other and a contacting state where the recording paper 11 and the process unit contact each other, under the control of the controller 3. As will be described later, the controller 3 determines the timing with which the first separating and contacting mechanism 6 is controlled to the separated state and the contacting state, based on an internal timer, for example.

Under the control of the controller 3, the fixing unit 7 thermally fixes the image transferred onto the recording paper 11 by making contact with and pressing against the recording paper 11. The second separating and contacting mechanism 17 includes a solenoid, an air pump or the like, and controls at least one of the recording paper 11 and each of rollers of the fixing unit 7 to a separated state where the recording paper 11 and the rollers of the fixing unit 7 are separated from each other and a contacting state where the recording paper 11 and the rollers of the fixing unit 7 contact each other, under the control of the controller 3. As will be described later, the controller 3 determines the timing with which the second separating and contacting mechanism 17 is controlled to the separated state and the contacting state, based on the internal timer, for example.

The paper separating part 8 supplies the recording paper 11 recorded with the image to an after-processing mechanism (not shown) or stacks the recording paper 11 recorded with the image on the stacker 9 within the printer 1, under the control of the controller 3. Perforations are formed at predetermined intervals on the recording paper 11, and the recording paper 11 is successively stacked on the stacker 9 by being alternately folded in mutually opposite directions along the perforations.

Figure 2:
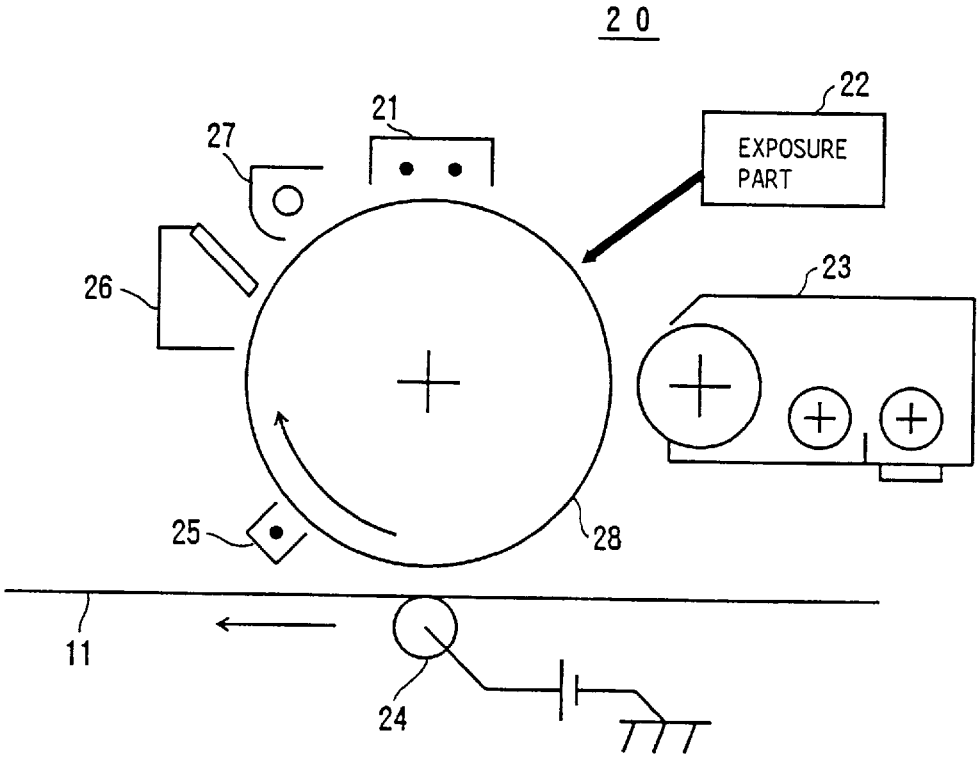
FIG. 2 is a diagram showing an embodiment of a process unit.

FIG. 2 is a diagram showing an embodiment of the process unit. In this embodiment, it is assumed for the sake of convenience that the process part 5 includes two process units each having the construction shown in FIG. 2. If the two process units are arranged so that the images are transferred onto the same side of the recording paper 11, it is possible to print the image in two colors using the two process units. On the other hand, if the two process units are arranged so that the images are transferred onto mutually different sides of the recording paper 11, it is possible to carry out a duplex printing.

As shown in FIG. 2, a process unit 20 generally includes a precharger 21, an exposure part 22, a developing part 23, a transfer part 24, an AC discharger 25, a cleaner part 26, a light emitting diode (LED) discharger 27, and a photoconductive body 28. In this embodiment, the photoconductive body 28 includes a photoconductive drum. At the time of the printing, the photoconductive body 28 is rotated clockwise by a known means as indicated by an arrow, and the surface of the photoconductive body 28 is uniformly charged by the precharger 21. The exposure part 22 exposes a pattern corresponding to the image which is to be recorded on the recording paper 11 on the surface of the photoconductive body 28, so as to form an electrostatic latent image. This electrostatic latent image is developed into a toner image by the developing part 23.

On the other hand, the recording paper 11 is transported by a known means in a direction indicated by an arrow in FIG. 2. Hence, as the photoconductive body 28 rotates, the toner image is transferred onto the transported recording paper 11 by the transfer part 24. This toner image is fixed by the fixing unit 7 shown in FIG. 1 which is provided at a subsequent stage.

The charge of the residual toner remaining on the surface of the photoconductive body 28 after the toner image is transferred onto the recording paper 11 is eliminated by the AC discharger 25 and is mechanically removed by a cleaning blade or a brush of the cleaner part 26. Thereafter, the LED discharger 27 returns the surface potential of the photoconductive body 28 to the initial stage (for example, 0 V).

Figure 3:
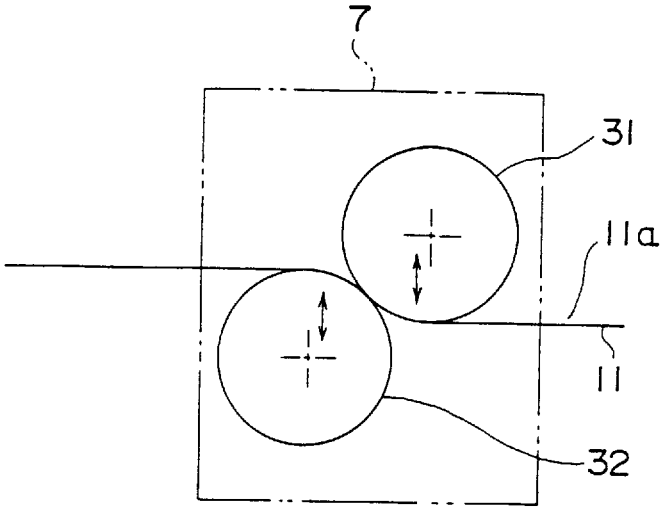
FIG. 3 is a diagram for explaining the fixing operation of the first embodiment.

FIG. 3 is a diagram for explaining the fixing operation of the first embodiment. In FIG. 3, the fixing unit 7 generally includes a fixing roller 31 and a pressing roller 32. The recording paper 11 is wrapped around the outer peripheral surfaces of the rollers 31 and 32 for a wrap-around angle Θ. This wrap-around angle Θ is the angle formed between a position where each of the rollers 31 and 32 start to make contact with the surfaces of the recording paper 11 and a position where each of the rollers 31 and 32 start to separate from the surfaces of the recording paper 11. For example, when recording the image on only a printing surface 11*a* of the recording paper 11, a known heating means is provided on the fixing roller 31, and it is not essential to provide a heating means on the pressing roller 32. On the other hand, when recording images on both sides of the recording paper 11, a heating means is provided on each of the fixing roller 31 and the pressing roller 32, and the two rollers 31 and 32 are both used as fixing and pressing rollers.

In order to carry out a high-speed printing, it is necessary to set a distance (so-called nip width) along the peripheral direction of each roller contacting the recording paper 11 in a state where each roller is slightly squashed, and the outer diameter of each roller to large values so as to obtain a stable fixing energy. However, there is a limit to increasing the pressing force which presses the two rollers against each other in order to increase the nip width. In addition, if the pressing force is excessively large, problems are introduced from the point of view of a restoration force of each roller, a stable transport of the recording paper 11 and the like. On the other hand, because there are strong demands to reduce the size of the printer, there is also a limit to increasing the outer diameter of each roller. For this reason, according to the conventional structure in which the pair of mutually confronting rollers press against each other via the recording paper 11 in a direction perpendicular to the surface of the recording paper 11, it is difficult to obtain a fixing energy which is sufficiently large to enable the high-speed printing. Hence, in this embodiment, the recording paper 11 is wrapped around the outer peripheral surfaces of the rollers 31 and 32 for the wrap-around angle Θas shown in FIG. 3, so as to set the nip width large. As a result, it is possible to obtain a preheating effect, thereby making it possible to obtain a sufficient fixing energy and a fixing efficiency that are necessary to cope with the high-speed printing.

When carrying out the above described back-feed of the recording paper 11, the second separating and contacting mechanism 17 operates and controls the rollers 31 and 32 and the recording paper 11 from the contacting state to the separated state. In addition, when a job is not carried out for a predetermined time, the second separating and contacting mechanism 17 similarly operates and controls the rollers 31 and 32 and the recording paper 11 from the contacting state to the separated state, because the recording paper 11 may become deformed or discolored if the recording paper 11 remains in the contacting state for a long time. However, when the recording paper 11 is wrapped around the outer peripheral surfaces of the rollers 31 and 32 for the wrap-around angle Θ as shown in FIG. 3, there is a possibility that the toner image which is not yet fixed on the recording paper 11 may be rubbed and disturbed when the rollers 31 and 32 separate from the recording paper 11. Particularly in the case of the duplex printing, the possibility that the toner image which is not yet fixed on the recording paper 11 is rubbed and disturbed is high. Therefore, in this embodiment, the toner image is prevented from becoming disturbed by using the following construction.

Figure 4:
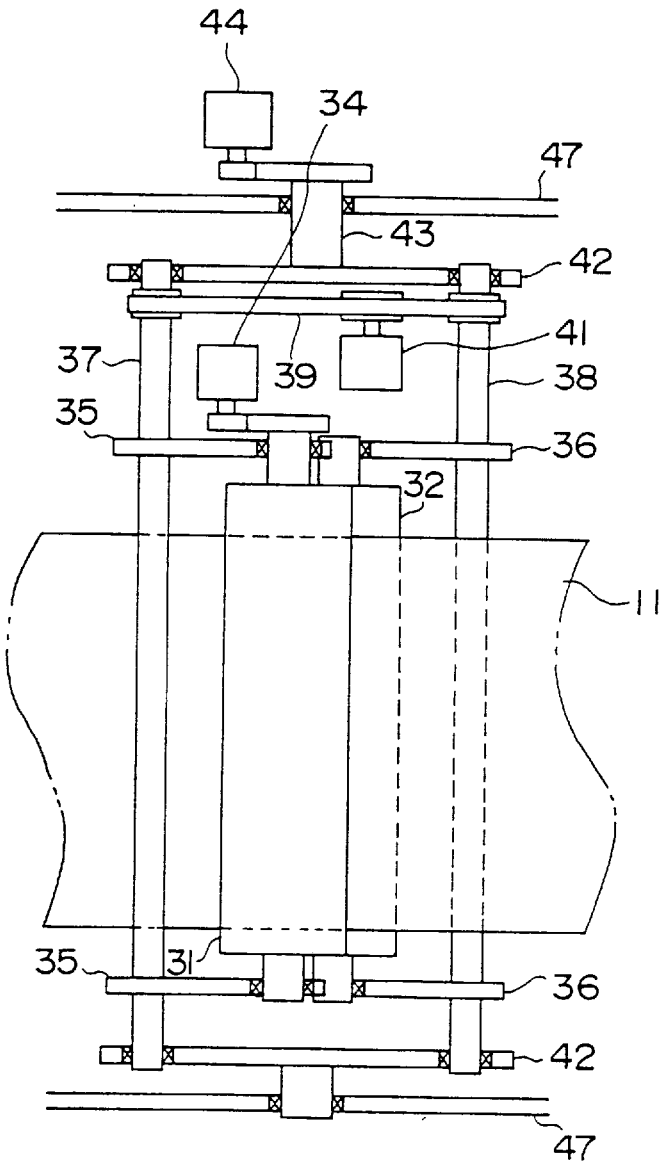
FIG. 4 is a plan view showing a fixing unit including a first embodiment of a second separating and contacting mechanism in a contacting state.

Next, a description will be given of a first embodiment of the second separating and contacting mechanism 17, by referring to FIGS. 4 and 5A through 5C. FIG. 4 is a plan view showing the fixing unit 7 including the second separating and contacting mechanism 17 in the contacting state, and FIGS. 5A through 5C respectively are side views showing an important part for explaining the operation of the second separating and contacting mechanism 17.

As shown in FIG. 4, the fixing roller 31 is rotatably supported by a pair of support plates 35, and similarly, the pressing roller 32 is rotatably supported by a pair of support plates 36. In addition, the support plates 35 are rotatably supported by rotary members 42 via a shaft 37, and the support plates 36 are rotatably supported by the same rotary members 42 via a shaft 38. The rotary members 42 are rotatably supported on a frame 47 via a shaft 43. A motor 34 is linked to the rotary shaft of the fixing roller 31, and rotates the fixing roller 31 under the control of the controller 3. Pulleys are provided on the shafts 37 and 38, and a belt 39 is provided across these pulleys. A motor 41 drives the belt 39 under the control of the controller 3, and rotate the shafts 37 and 38 in the same direction. A motor 44 is linked to the shaft 43, and rotates he rotary members 42 under the control of the controller 3. Of course, the motor 34 may rotate the pressing roller 32 in place of the fixing roller 31.

The support plates 35 and 36, the shafts 37 and 38, the rotary members 42, the shaft 43, and the motors 41 and 44 form the second separating and contacting mechanism 17.

Figure 5A:
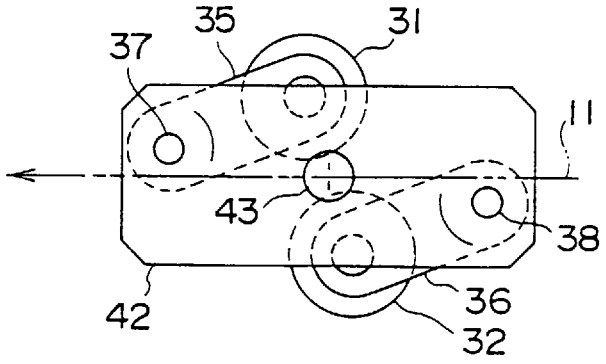
FIGS. 5A, 5B and 5C respectively are side views showing an important part for explaining the operation of the first embodiment of the second separating and contacting mechanism.

In the separated state, the rollers 31 and 32 assume the state shown in FIG. 5A. In this separated state, with respect to the surface of the recording paper 11, the fixing roller 31 turns upwards about the shaft 37 by the support plates 35, the pressing roller 32 turns downwards about the shaft 38 by the support plates 36, and both the rollers 31 and 32 are separated from the recording paper 11. In addition, an imaginary line connecting the shafts of the rollers 31 and 32 is tilted with respect to an imaginary line which is perpendicular to the surface of the recording paper 11.

Figure 5B:
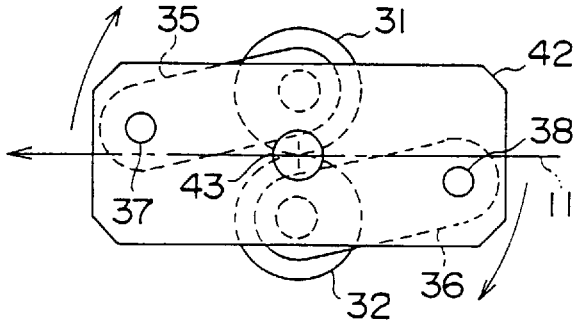

When the contacting operation of the second separating and contacting mechanism 17 starts under the control of the controller 3, the motor 41 is first started, and the support plates 35 and 36 turn clockwise in FIG. 5A. As a result, the fixing roller 31 and the pressing roller 32 make contact with the recording paper 11 as shown in FIG. 5B, and press against each other via the recording paper 11. In this state, the imaginary line connecting the shafts of the rollers 31 and 32 is approximately parallel to the imaginary line which is perpendicular to the surface of the recording paper 11 at a contact point (pressing point).

Figure 5C:
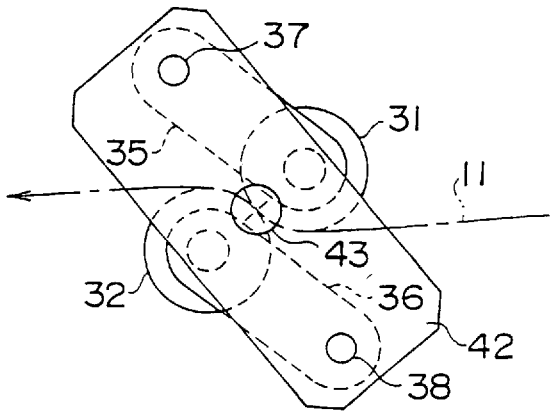

Next, the motor 41 is stopped and the motor 44 is driven, so that the rotary members 42 turn clockwise as indicated by arrows in FIG. 5B about the shaft 43. Hence, the fixing roller 31 and the pressing roller 32 roll along each other's outer peripheral surface via the recording paper 11, generally about the pressing point with respect to the recording paper 11, as shown in FIG. 5C. Consequently, the recording paper 11 is wrapped around the outer peripheral surfaces of the fixing roller 31 and the pressing roller 32 for the wrap-around angle Θ, and in this contacting state, the motor 44 is also stopped.

Accordingly, the imaginary line connecting the shafts of the rollers 31 and 32 turns clockwise approximately about the shaft 43 from the position shown in FIG. 5A, and at the position shown in FIG. 5B, this imaginary line connecting the shafts of the rollers 31 and 32 becomes approximately parallel to the imaginary line which is perpendicular to the surface of the recording paper 11 at the pressing point. Furthermore, the imaginary line connecting the shafts of the rollers 31 and 32 further turns approximately about the shaft 43 from the position shown in FIG. 5B, and at the position shown in FIG. 5C, this imaginary line connecting the shafts of the rollers 31 and 32 is also approximately parallel to the imaginary line which is perpendicular to the surface of the recording paper 11 at the pressing point. In other words, the fixing roller 31 and the pressing roller 32 are driven so that, after these rollers 31 and 32 press approximately perpendicularly against the surface of the recording paper 11, the recording paper 11 wraps around the outer peripheral surfaces of the fixing roller 31 and the pressing roller 32 for the wrap-around angle Θ. Moreover, since the moving quantity of the recording paper 11 is small when the recording paper 11 wraps around the outer peripheral surfaces of the fixing roller 31 and the pressing roller 32, the stress applied on the recording paper 11 is extremely small. For this reason, it is possible to greatly reduce the possibility of the toner image on the recording paper 11 which is not yet fixed from being rubbed and disturbed when the fixing roller 31 and the pressing roller 32 make contact with the surface of the recording paper 11.

The separating operation of the second separating and contacting mechanism 17 is carried out in a sequence which is in reverse to that of the contacting operation described above. As a result, from the contacting state shown in FIG. 5C, the separated state shown in FIG. 5A is obtained via the state shown in FIG. 5B. In the case of the separating operation, it is also possible to greatly reduce the possibility of the toner image on the recording paper 11 which is not yet fixed from being rubbed and disturbed when the fixing roller 31 and the pressing roller 32 separate from the surface of the recording paper 11, for reasons similar to those described above.

The motor 34 is driven depending on the operation state of the second separating and contacting mechanism 17 or the like, under the control of the controller 3. Preferably, the contacting operation and the separating operation of the second separating and contacting mechanism 17 are started in a state where the peripheral speed of the fixing roller 31 and the transport speed of the recording paper 11 are approximately the same, including the case where the speeds are zero.

Figure 6:
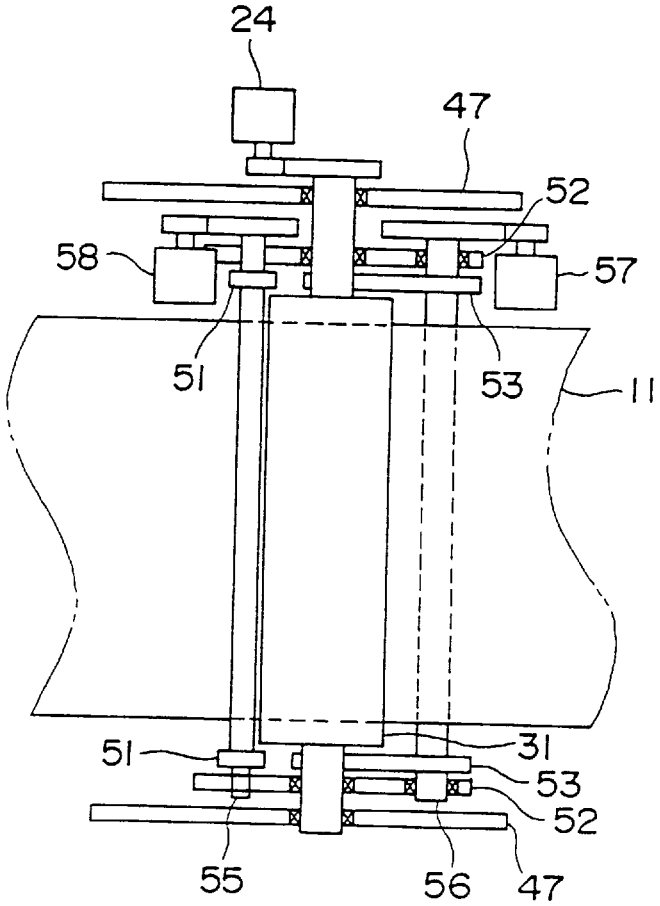
FIG. 6 is a plan view showing the fixing unit including a second embodiment of the second separating and contacting mechanism in the contacting state.

Next, a description will be given of a second embodiment of the second separating and contacting mechanism 17, by referring to FIGS. 6 and 7A through 7C. FIG. 6 is a plan view showing the fixing unit 7 including the second separating and contacting mechanism 17 in the contacting state, and FIGS. 7A through 7C respectively are side views showing an important part for explaining the operation of the second separating and contacting mechanism 17. In FIGS. 6 and 7A through 7C, those parts which are the same as those corresponding parts in FIGS. 4 and 5A through 5C are designated by the same reference numerals, and a description thereof will be omitted.

As shown in FIG. 6, links 51 are fixed on the frame 47 or the like, and support members 52 are linked to the links 51 via a shaft 55. Support members 53 are linked to the support members 52 via a shaft 56. The shaft 55 engages elongated holes in the support members 52. The fixing roller 31 is rotatably supported approximately at the central portions of the support members 52. The pressing roller 32 is rotatably supported at tip end portions of the support members 53.

The links 51, the support members 52 and 53, the shafts 55 and 56, and motors 57 and 58 form the second separating and contacting mechanism 17.

Figure 7A:
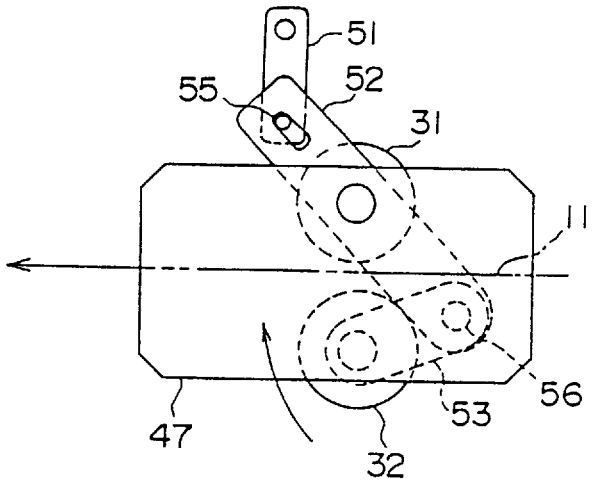
FIGS. 7A, 7B and 7C respectively are side views showing an important part for explaining the operation of the second embodiment of the second separating and contacting mechanism.

In the separated state, the rollers 31 and 32 assume the state shown in FIG. 7A. In this separated state, with respect to the surface of the recording paper 11, the fixing roller 31 is located at a position turned slightly counterclockwise from the vertical position about the shaft 55 by the support members 52, and the pressing roller 32 is located at a position turned slightly counterclockwise about the shaft 56 by the support members 53. Hence, both the rollers 31 and 32 are separated from the recording paper 11. In addition, the imaginary line connecting the shafts of the rollers 31 and 32 is approximately parallel to the imaginary line which is perpendicular to the surface of the recording paper 11.

Figure 7B:
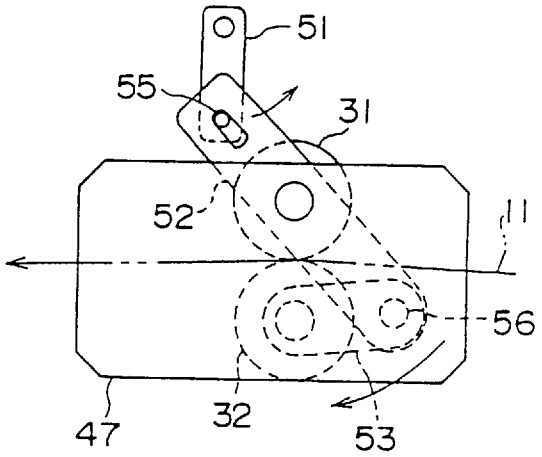

When the contacting operation of the second separating and contacting mechanism 17 is started under the control of the controller 3, the motor 57 is first started, and the support members 53 turn clockwise as indicated by an arrow in FIG. 7A. As a result, the fixing roller 31 and the pressing roller 32 make contact with the recording paper 11 as shown in FIG. 7B, and press against each other via the recording paper 11. In this state, the imaginary line connecting the shafts of the rollers 31 and 32 is also approximately parallel to the imaginary line which is perpendicular to the surface of the recording paper 11 at the pressing point.

Figure 7C:
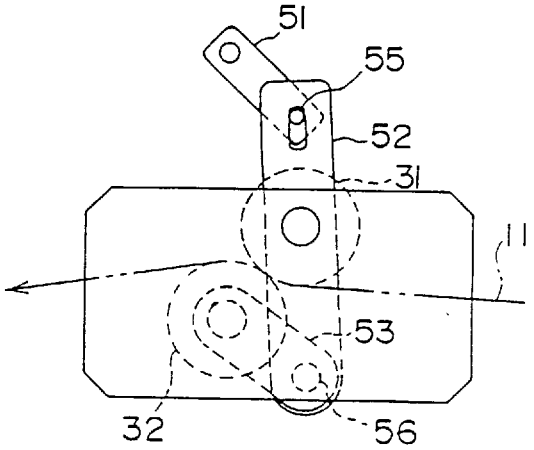

Next, the motor 57 is stopped and the motor 58 is driven, so that the support members 52 turn clockwise as indicated by an arrow in FIG. 7B. Hence, the fixing roller 31 and the pressing roller 32 roll along each other's outer peripheral surface via the recording paper 11, with respect to the recording paper 11, as shown in FIG. 7C. Consequently, the recording paper 11 is wrapped around the outer peripheral surfaces of the fixing roller 31 and the pressing roller 32 for the wrap-around angle Θ, and in this contacting state, the motor 58 is also stopped.

Accordingly, the imaginary line connecting the shafts of the rollers 31 and 32 turns clockwise from the position shown in FIGS. 7A and 7B, and at the position shown in FIG. 7C, this imaginary line connecting the shafts of the rollers 31 and 32 is also approximately parallel to the imaginary line which is perpendicular to the surface of the recording paper 11 at the pressing point. In other words, the fixing roller 31 and the pressing roller 32 are driven so that, after these rollers 31 and 32 press approximately perpendicularly against the surface of the recording paper 11, the recording paper 11 wraps around the outer peripheral surfaces of the fixing roller 31 and the pressing roller 32 for the wrap-around angle Θ. Moreover, since the moving quantity of the recording paper 11 is small when the recording paper 11 wraps around the outer peripheral surfaces of the fixing roller 31 and the pressing roller 32, the stress applied on the recording paper 11 is extremely small. For this reason, it is possible to greatly reduce the possibility of the toner image on the recording paper 11 which is not yet fixed from being rubbed and disturbed when the fixing roller 31 and the pressing roller 32 make contact with the surface of the recording paper 11.

The separating operation of the second separating and contacting mechanism 17 is carried out in a sequence which is in reverse to that of the contacting operation described above. As a result, from the contacting state shown in FIG. 7C, the separated state shown in FIG. 7A is obtained via the state shown in FIG. 7B. In the case of the separating operation, it is also possible to greatly reduce the possibility of the toner image on the recording paper 11 which is not yet fixed from being rubbed and disturbed when the fixing roller 31 and the pressing roller 32 separate from the surface of the recording paper 11, for reasons similar to those described above.

Figure 8:
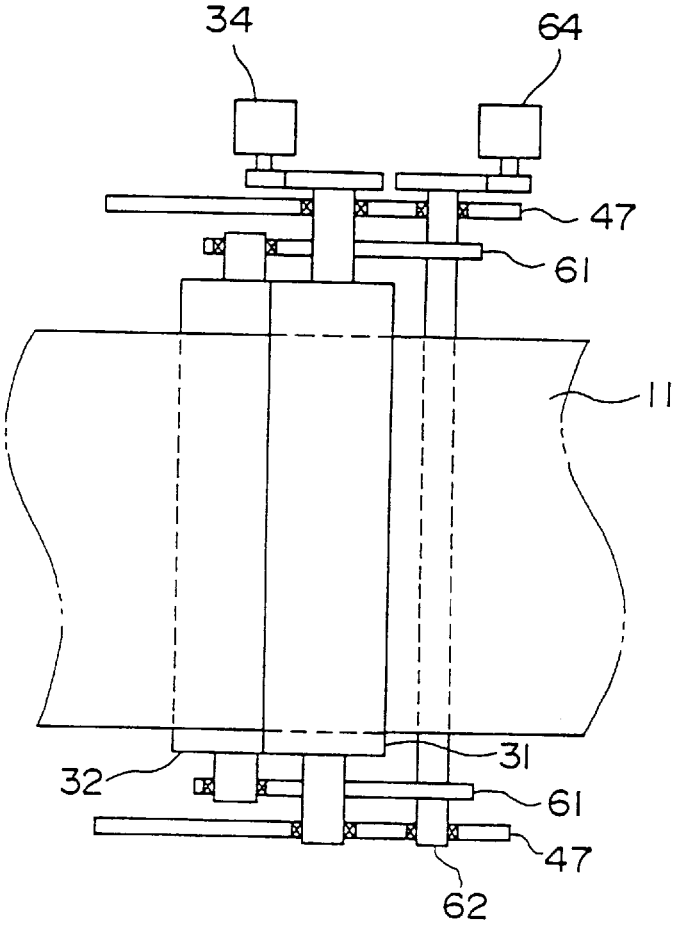
FIG. 8 is a plan view showing the fixing unit including a third embodiment of the second separating and contacting mechanism in the contacting state.
Figure 9A:
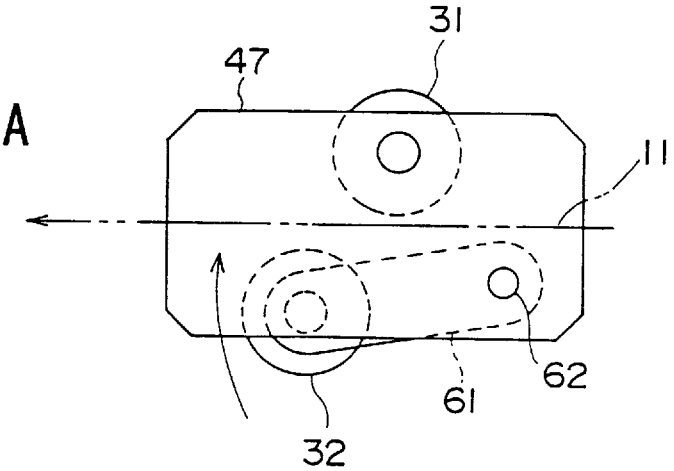
FIGS. 9A and 9B respectively are side views showing an important part for explaining the operation of the third embodiment of the second separating and contacting mechanism.
Figure 9B:
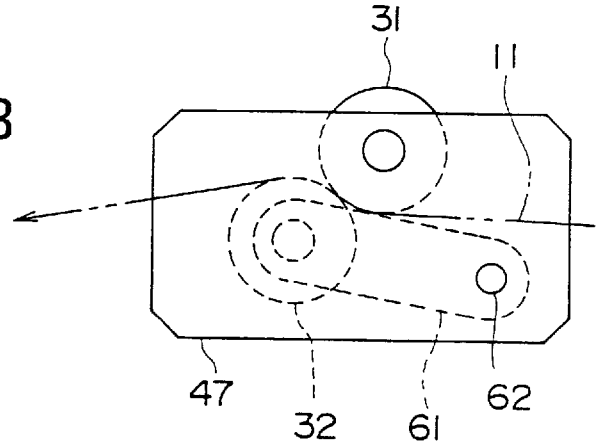

Next, a description will be given of a third embodiment of the second separating and contacting mechanism 17, by referring to FIGS. 8 and 9A and 9B. FIG. 8 is a plan view showing the fixing unit 7 including the second separating and contacting mechanism 17 in the contacting state, and FIGS. 9A and 9B respectively are side views showing an important part for explaining the operation of the second separating and contacting mechanism 17. In FIGS. 8, 9A and 9B, those parts which are the same as those corresponding parts in FIGS. 4 and 5A through 5C are designated by the same reference numerals, and a description thereof will be omitted.

As shown in FIG. 8, support members 61 are rotatably supported on the frame 47 via a shaft 62. The pressing roller 32 is rotatably supported at the tip end portions of the support members 61. On the other hand, the fixing roller 31 is rotatably supported on the frame 47.

The support members 61, the shaft 62, and a motor 64 form the second separating and contacting mechanism 17.

In the separated state, the rollers 31 and 32 assume the state shown in FIG. 9A. In this separated state, with respect to the surface of the recording paper 11, the pressing roller 32 is located at a position turned slightly counterclockwise from the horizontal position about the shaft 62 by the support members 61, and both the rollers 31 and 32 are separated from the recording paper 11. In addition, the imaginary line connecting the shafts of the rollers 31 and 32 is tilted with respect to the imaginary line which is perpendicular to the surface of the recording paper 11.

When the contacting operation of the second separating and contacting mechanism 17 is started under the control of the controller 3, the motor 64 is first started, and the support members 61 turn clockwise as indicated by an arrow in FIG. 9A. As a result, the fixing roller 31 and the pressing roller 32 make contact with the recording paper 11 as shown in FIG. 9B, and press against each other via the recording paper 11. Hence, the fixing roller 31 and the pressing roller 32 roll along each other's outer peripheral surface via the recording paper 11, with respect to the recording paper 11, as shown in FIG. 9B. Consequently, the recording paper 11 is wrapped around the outer peripheral surfaces of the fixing roller 31 and the pressing roller 32 for the wrap-around angle Θ, and in this contacting state, the motor 64 is stopped. In this state, the imaginary line connecting the shafts of the rollers 31 and 32 is also approximately parallel to the imaginary line which is perpendicular to the surface of the recording paper 11 at the pressing point.

Accordingly, the imaginary line connecting the shafts of the rollers 31 and 32 turns clockwise from the position shown in FIG. 9A, and at the position shown in FIG. 9B, this imaginary line connecting the shafts of the rollers 31 and 32 is approximately parallel to the imaginary line which is perpendicular to the surface of the recording paper 11 at the pressing point. In other words, the fixing roller 31 and the pressing roller 32 are driven so that, after these rollers 31 and 32 press approximately perpendicularly against the surface of the recording paper 11, the recording paper 11 wraps around the outer peripheral surfaces of the fixing roller 31 and the pressing roller 32 for the wrap-around angle Θ. Moreover, since the moving quantity of the recording paper 11 is small when the recording paper 11 wraps around the outer peripheral surfaces of the fixing roller 31 and the pressing roller 32, the stress applied on the recording paper 11 is extremely small. In addition, because the recording paper 11 is secured by the transport means provided on the upstream side in the transport direction of the recording paper 11 when the pressing roller 32 lifts the recording paper 11, the recording paper 11 will not slip on the upstream side. For this reason, it is possible to greatly reduce the possibility of the toner image on the recording paper 11 which is not yet fixed from being rubbed and disturbed when the fixing roller 31 and the pressing roller 32 make contact with the surface of the recording paper 11.

The separating operation of the second separating and contacting mechanism 17 is carried out in a sequence which is in reverse to that of the contacting operation described above. As a result, from the contacting state shown in FIG. 9B, the separated state shown in FIG. 9A is obtained. In the case of the separating operation, it is also possible to greatly reduce the possibility of the toner image on the recording paper 11 which is not yet fixed from being rubbed and disturbed when the fixing roller 31 and the pressing roller 32 separate from the surface of the recording paper 11, for reasons similar to those described above.

Figure 10:
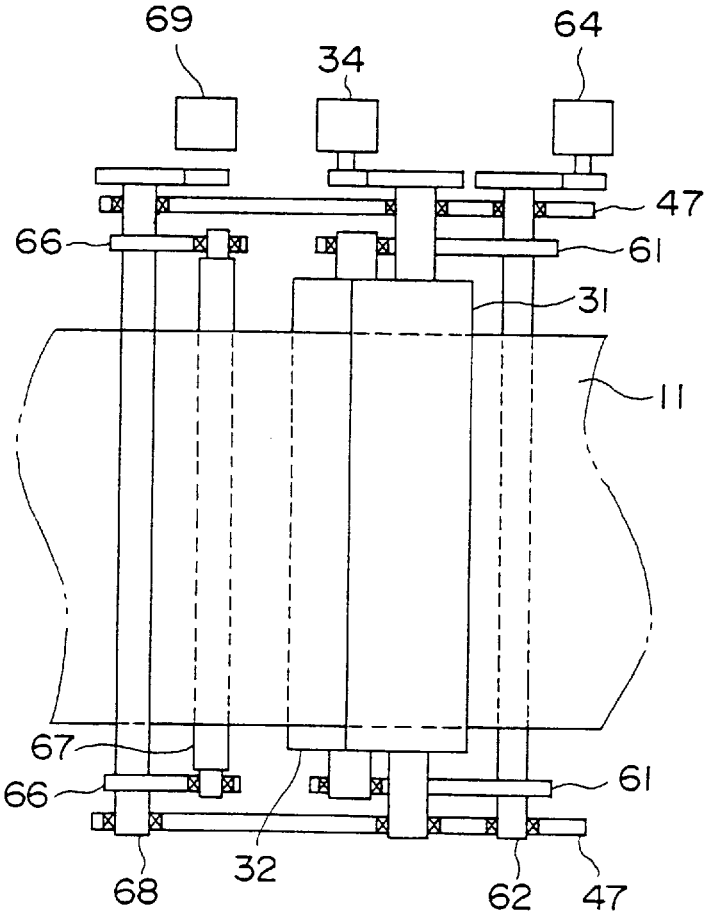
FIG. 10 is a plan view showing the fixing unit including a fourth embodiment of the second separating and contacting mechanism in the contacting state.

Next, a description will be given of a fourth embodiment of the second separating and contacting mechanism 17, by referring to FIGS. 10 and 11A through 11C. FIG. 10 is a plan view showing the fixing unit 7 including the second separating and contacting mechanism 17 in the contacting state, and FIGS. 11A through 11C respectively are side views showing an important part for explaining the operation of the second separating and contacting mechanism 17. In FIGS. 10 and 11A through 11C, those parts which are the same as those corresponding parts in FIGS. 8, 9A and 9B are designated by the same reference numerals, and a description thereof will be omitted.

As shown in FIG. 10, tension arms 66 are rotatably supported on the frame 47 via a shaft 68. A tension roller 67 is rotatably supported at the tip end portions of the tension arms 66. The fixing roller 31 is rotatably supported on the frame 47, and the pressing roller 32 is rotatably supported on the support members 61. On the other hand, the fixing roller 31 is rotatably supported on the frame 47.

The support members 61, the tension arms 66, the shafts 62 and 68, the tension roller 67, and the motors 64 and 69 form the second separating and contacting mechanism 17.

Figure 11A:
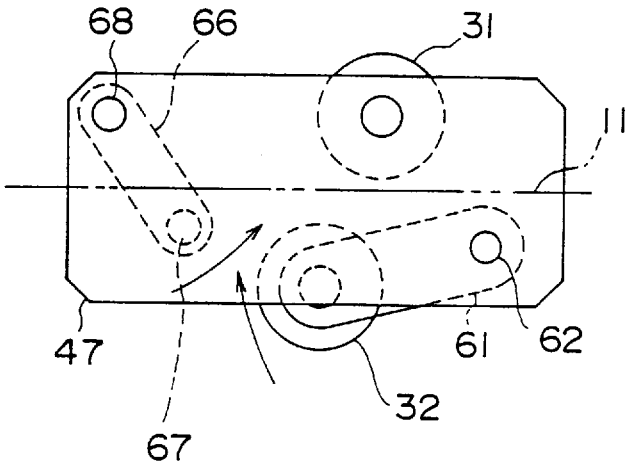
FIGS. 11A, 11B and 11C respectively are side views showing an important part for explaining the operation of the fourth embodiment of the second separating and contacting mechanism.

In the separated state, the rollers 31 and 32 assume the state shown in FIG. 11A. In this separated state, with respect to the surface of the recording paper 11, the pressing roller 32 is located at a position turned slightly counterclockwise from the horizontal position about the shaft 62 by the support members 61, and both the rollers 31 and 32 are separated from the recording paper 11. In addition, the imaginary line connecting the shafts of the rollers 31 and 32 is tilted with respect to the imaginary line which is perpendicular to the surface of the recording paper 11. Further, the tension roller 67 is located at a position separated from the recording paper 11.

Figure 11B:
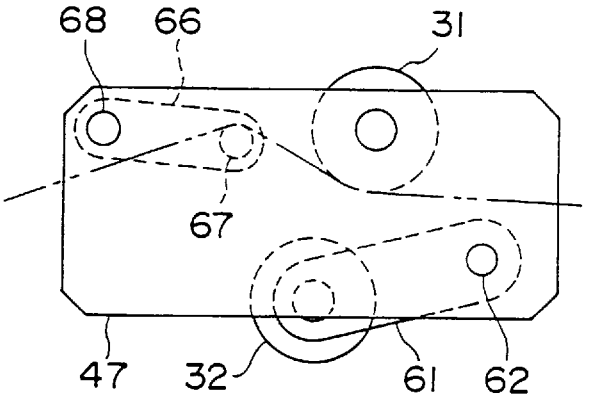

When the contacting operation of the second separating and contacting mechanism 17 is started under the control of the controller 3, the motor 69 is first started, and the tension arm 66 turns counterclockwise as indicated by an arrow in FIG. 11A. As a result, the tension roller 67 makes contact with the recording paper 11, and lifts the recording paper 11 from the horizontal position as shown in FIG. 11B. Since the tension roller 67 makes contact with the recording paper 11 which is already subjected to the fixing process, the toner image will not be disturbed upon contact between the tension roller 67 and the recording paper 11.

Figure 11C:
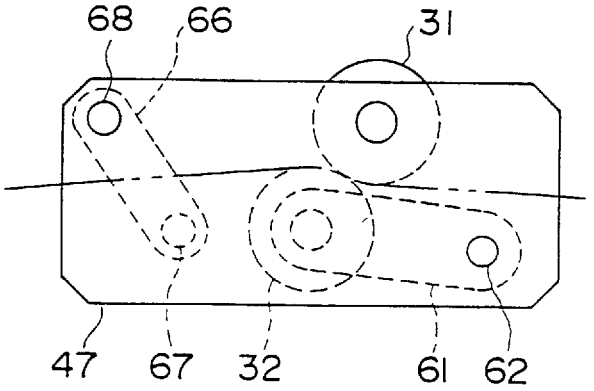

Next, the motor 64 is driven, and the support members 61 turn clockwise as indicated by an arrow in FIG. 11A. As a result, the fixing roller 31 and the pressing roller 32 make contact with the recording paper 11 as shown in FIG. 11C, and press against each other via the recording paper 11. Hence, the fixing roller 31 and the pressing roller 32 roll along each other's outer peripheral surface via the recording paper 11, with respect to the recording paper 11, as shown in FIG. 11C. Consequently, the recording paper 11 is wrapped around the outer peripheral surfaces of the fixing roller 31 and the pressing roller 32 for the wrap-around angle Θ, and in this contacting state, the motors 69 and 64 are stopped. By stopping the motor 69, the tension arm 66 shown in FIG. 11C returns to the receded position identical to that shown in FIG. 11A. In the state shown in FIG. 11C, the imaginary line connecting the shafts of the rollers 31 and 32 is also approximately parallel to the imaginary line which is perpendicular to the surface of the recording paper 11 at the pressing point.

Accordingly, the imaginary line connecting the shafts of the rollers 31 and 32 turns clockwise from the position shown in FIGS. 11A and 11B, and at the position shown in FIG. 11C, this imaginary line connecting the shafts of the rollers 31 and 32 is approximately parallel to the imaginary line which is perpendicular to the surface of the recording paper 11 at the pressing point. In other words, the fixing roller 31 and the pressing roller 32 are driven so that, after these rollers 31 and 32 press approximately perpendicularly against the surface of the recording paper 11, the recording paper 11 wraps around the outer peripheral surfaces of the fixing roller 31 and the pressing roller 32 for the wrap-around angle Θ. Moreover, since the moving quantity of the recording paper 11 is small when the recording paper 11 wraps around the outer peripheral surfaces of the fixing roller 31 and the pressing roller 32, the stress applied on the recording paper 11 is extremely small. In addition, because the recording paper 11 is, secured by the transport means provided on the upstream side in the transport direction of the recording paper 11 when the tension roller 67 lifts the recording paper 11, the recording paper 11 will not slip on the upstream side. For this reason, it is possible to greatly reduce the possibility of the toner image on the recording paper 11 which is not yet fixed from being rubbed and disturbed when the fixing roller 31 and the pressing roller 32 make contact with the surface of the recording paper 11.

The separating operation of the second separating and contacting mechanism 17 is carried out in a sequence which is in reverse to that of the contacting operation described above. As a result, from the contacting state shown in FIG. 11C, the separated state shown in FIG. 11A is obtained via the state shown in FIG. 11B. In the case of the separating operation, it is also possible to greatly reduce the possibility of the toner image on the recording paper 11 which is not yet fixed from being rubbed and disturbed when the fixing roller 31 and the pressing roller 32 separate from the surface of the recording paper 11, for reasons similar to those described above.

The fixing roller 31 may be a hard roller or a semi-soft roller which is an intermediate between the hard roller and a soft roller. For example, the semi-soft roller is made of an aluminum core, an intermediate member such as silicon rubber covering the aluminum core, and a PFA tubing provided on the silicon rubber. Similarly, the pressing roller 32 may be a hard roller or a semi-soft roller. It is desirable to select the hard roller or the semi-soft roller for use as the fixing roller 31 and the pressing roller 32 depending on various conditions such as whether the printing to be carried out is a single side printing, duplex printing, single color printing or multi-color printing, a range of the thickness of the recording paper 11 used and the like. Although the illustration thereof will be omitted, a known heating means (one or a plurality of heaters, halogen lamps and the like) are provided within at least the fixing roller 31, and preferably, a similar heating means is also provided within the pressing roller 32.

Figure 12:
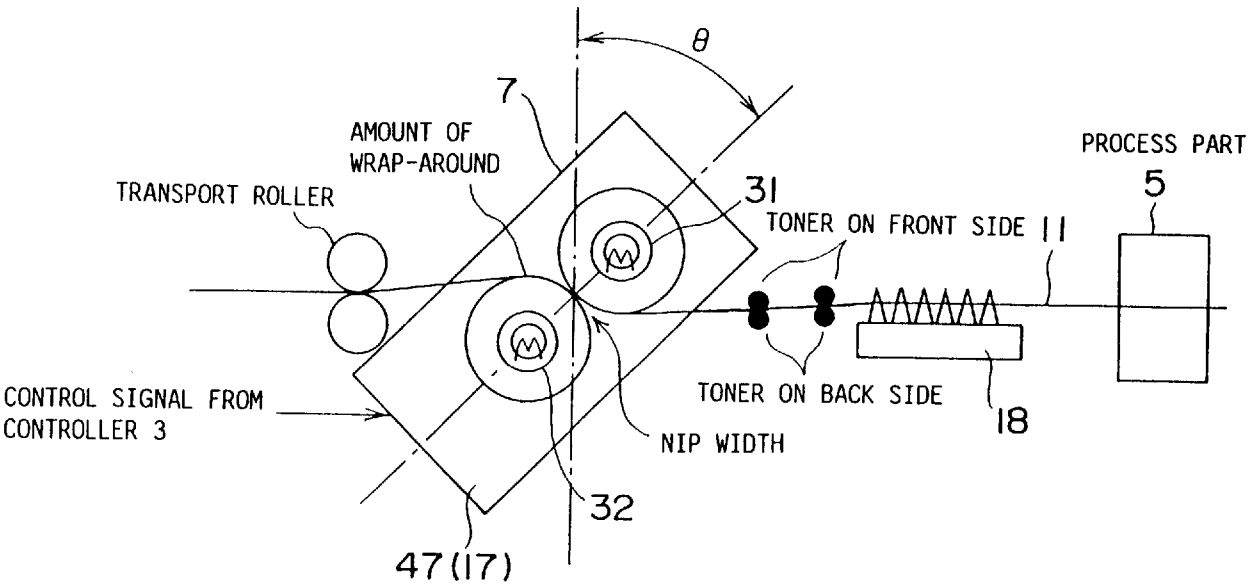
FIG. 12 is a diagram showing the construction of the fixing unit and its peripheral part in a second embodiment of the image forming apparatus according to the present invention.

Next, a description will be given of a second embodiment of the image forming apparatus according to the present invention, by referring to FIG.12. The basic construction of the second embodiment of the image forming apparatus is the same as the basic construction of the first embodiment shown in FIG.1, and thus, illustration and description related to the basic construction will be omitted. FIG.12 is a diagram showing the construction of the fixing unit 7 and its peripheral part of the second embodiment of the image forming apparatus. For the sake of convenience, it is assumed that the second separating and contacting mechanism 17 itself uses the first embodiment of the second separating and contacting mechanism 17 shown in FIGS. 4 and 5A through 5C.

In this embodiment, when the frame 47 supporting the fixing roller 31 and the pressing roller 32 is turned as shown in FIG. 5C, the wrap-around angle Θ of the recording paper 11 which is wrapped around the outer peripheral surfaces of the fixing roller 31 and the pressing roller 32 is variably set by variably setting the turning angle of the frame 47. More particularly, a driving time of the motor 44 is variably controlled based on control information that is input to the controller 3. As a result, it is possible to set the wrap-around angle Θ to an optimum value depending on the thickness or characteristic of the recording paper 11 used, the kind or amount of the toner forming the toner image which is transferred onto the recording paper 11 but is not yet fixed, and the like. For example, the wrap-around angle Θ is set to a value which is greater than 0° and is less than or equal to approximately 90°.

Next, a description will be given of a first modification of the second embodiment of the image forming apparatus. In this modification, at least one of the conditions such as the thickness or characteristic of the recording paper 11 used, the kind or amount of the toner forming the toner image which is transferred onto the recording paper 11 but is not yet fixed is detected, and the wrap-around angle Θ is automatically set depending on the detected condition. This modification uses the sensor 10 shown in FIG. 1.

For example, an optical sensor, a microswitch or the like is used as the sensor 10 when detecting the thickness, characteristic and the like of the recording paper 11. In the case of the optical sensor, the sensor 10 detects the thickness and characteristic of the recording paper 11 by detecting the intensity of light transmitted through a non-printing region of the recording paper 11 or the intensity of light transmitted through the transport path 12 if no recording paper 11 exits. For example, an output signal of the sensor 10 is 5 V when no recording paper 11 exists, 3.0 V in the case of a thin, recording paper 11, and 1.8 V in the case of a thick recording paper 11. The output signal of the sensor 10 is supplied to the controller 3. Since the controller 3 can recognize the thickness, characteristic and the like of the recording paper 11 from the output signal of the sensor 10, the controller 3 automatically and variably controls the driving time of the motor 44 based on the output signal of the sensor 10. Hence, it is possible to automatically set the wrap-around angle Θ to an optimum value depending on the thickness, characteristic and the like of the recording paper 11 that is used.

In addition, in the case of the optical sensor, the sensor 10 can also detect the kind, amount and the like of the toner forming the toner image which is transferred onto the recording paper 11 but is not yet fixed, by detecting the intensity of light transmitted through or reflected by a printing region on the recording paper 11. For example, when detecting the reflected light, the output signal of the sensor 10 is 0 V when no recording paper 11 exists, 1.8 V when the amount of toner adhered on the recording paper 11 is small such as the case of the single color printing, and 3.0 V when the amount of toner adhered on the recording paper 11 is large such as the case of the multi-color printing. The output signal of the sensor 10 is supplied to the controller 3. Since the controller 3 can recognize the kind, amount and the like of the toner forming the toner image which is transferred onto the recording paper 11 but is not yet fixed from the output signal of the sensor 10, the controller 3 automatically variably controls the driving time of the motor 44 based on the output signal of the sensor 10. As a result, it is possible to automatically set the wrap-around angle Θ to an optimum value depending on the kind, amount and the like of the toner forming the toner image which is transferred onto the recording paper 11 but is not yet fixed, that is, depending on a print mode of the printer.

The sensor 10 may also be made up of one or a plurality of sensors which detect both the paper conditions and the toner conditions, where the paper conditions include the thickness, characteristic and the like of the recording paper 11 that is used, and the toner conditions include the kind, amount and the like of the toner forming the toner image which is transferred onto the recording paper 11 but is not yet fixed. In this case, the controller 3 can automatically set the wrap-around angle Θ to an optimum value by automatically and variably controlling the driving time of the motor 44 based on the output signal of the sensor 10, by taking into consideration both the paper conditions and the toner conditions.

Figure 13:
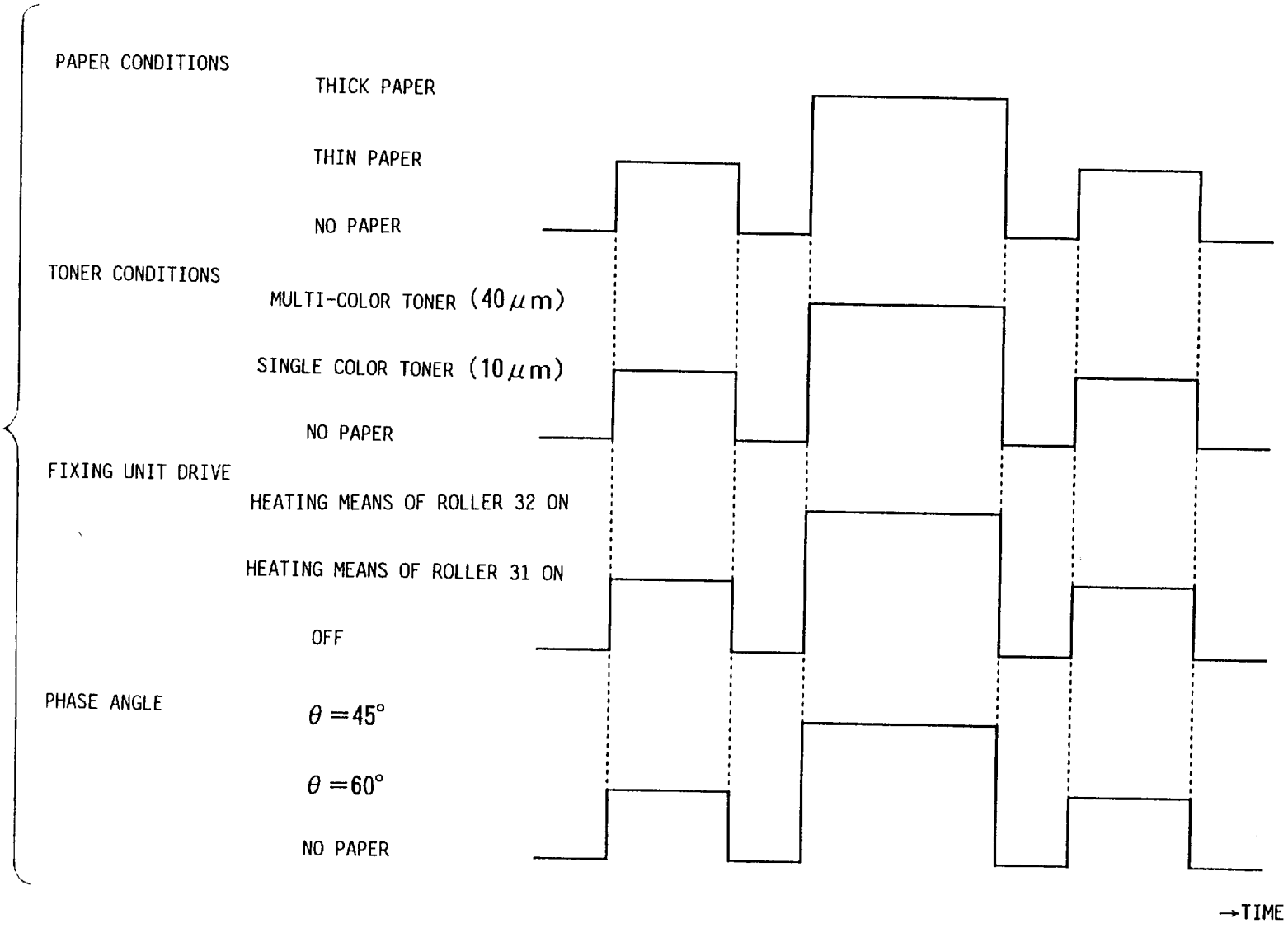
FIG. 13 is a time chart showing the relationship of paper conditions, toner conditions, ON/OFF states of heating means, and a wrap-around angle Θ, with respect to a first modification of the second embodiment.

FIG. 13 is a time chart showing the relationship of the paper conditions including the thickness, characteristic and the like of the recording paper 11, the toner conditions including the kind, amount and the like of the toner forming the toner image which is transferred onto the recording paper 11 but is not yet fixed, the ON/OFF states of the heating means of the fixing roller 31 and the heating means of the pressing roller 32, and the wrap-around angle Θ which is variably controlled by the controller 3, with respect to this first modification. For example, it is assumed for the sake of convenience that a pressing force of 135 kg is required when the recording paper 11 is a thick paper, and a pressing force of 55 kg is required when the recording paper 11 is a thin paper. In addition, it is also assumed that the thickness of the toner layer is approximately 40 μm when the amount of toner adhered on the recording paper 11 is large, and the thickness of the toner layer is approximately 10 μm when the amount of toner adhered on the recording paper 11 is small.

In the case where the sensor 10 detects the paper conditions, the location where the sensor 10 is provided is not limited to a certain location as long as the sensor 10 can detect the thickness or the like of the recording paper 11. On the other hand, in the case where the sensor 10 detects the toner conditions, it is desirable that the sensor 10 is provided at a location on the downstream side of the process part 5 in the transport direction of the recording paper 11 and on the upstream side of the fixing unit 7 in the transport direction of the recording paper 11.

Next, a description will be given of a second modification of the second embodiment of the image forming apparatus. In this modification, at least one of the conditions including the thickness, characteristic and the like of the recording paper 11 that is used and the kind, amount and the like of the toner forming the toner image which is transferred onto the recording paper 11 but is not yet fixed is detected, and at least one of the heating means of the fixing roller 31 and the heating means of the pressing roller 32 is automatically set depending on the detected condition. This modification also uses the sensor 10 shown in FIG. 1.

A sensor similar to that used in the first modification described above may also be used as the sensor 10 in this modification. In this modification, the controller 3 automatically and variably controls the heating quantity of the heating means based on the output signal of the sensor 10. As a result, it is possible to automatically set the heating quantity to an optimum value depending on at least one of the paper conditions and the toner conditions. Hence, it is possible to obtain an optimum fixing efficiency according to the paper or toner condition.

Furthermore, it is of course possible to combine the first and second modifications described above.

Figure 14:
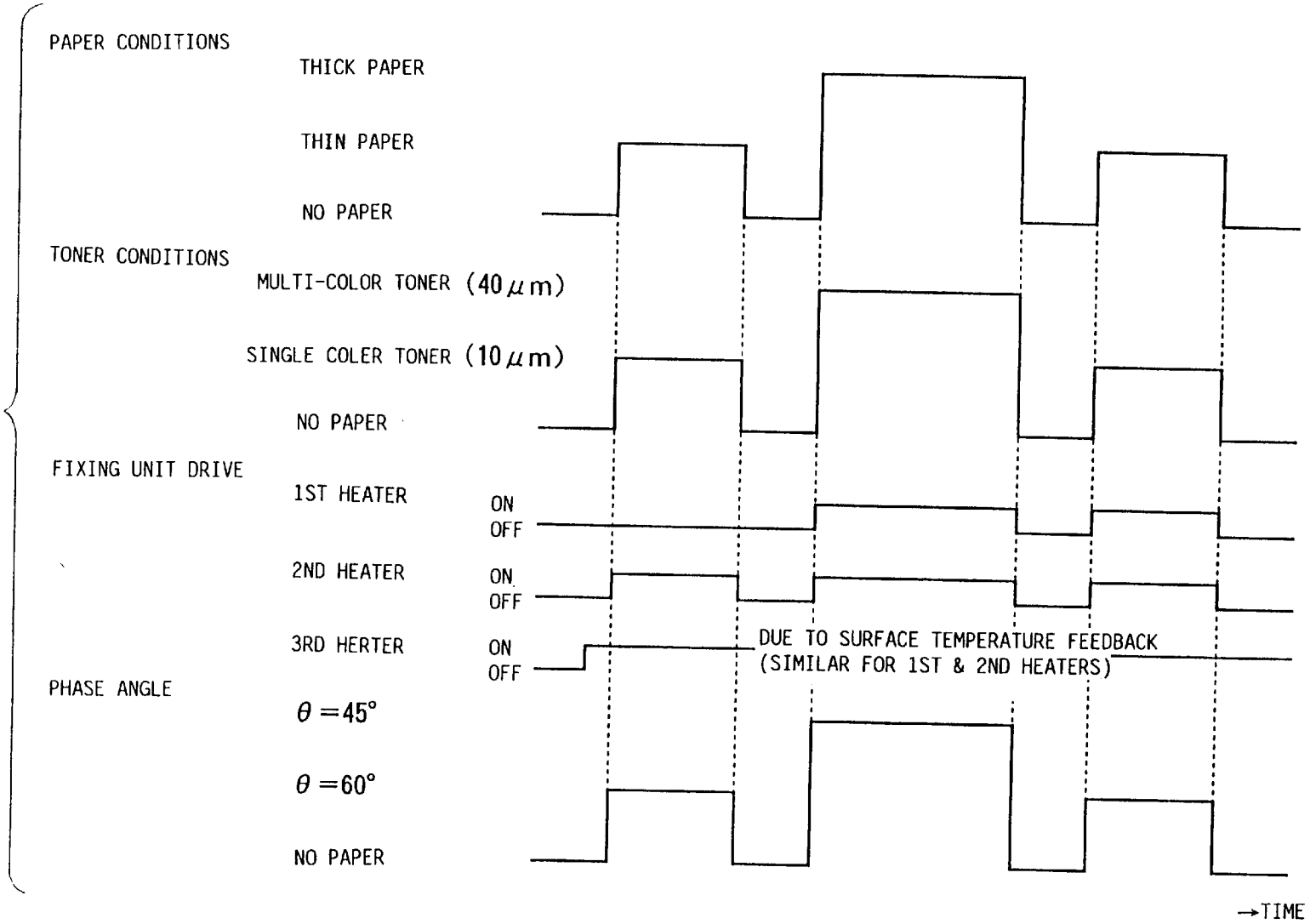
FIG. 14 is a time chart showing the relationship of the paper conditions, the toner conditions, ON/OFF states of heaters, and the wrap-around angle Θ, with respect to a combination of the first and second modifications of the second embodiment.

FIG. 14 is a time chart showing the relationship of the paper conditions including the thickness, characteristic and the like of the recording paper 11, the toner conditions including the kind, amount and the like of the toner forming the toner image which is transferred onto the recording paper 11 but is not yet fixed, the ON/OFF states of three heaters forming the heating means of the fixing roller 31, and the wrap-around angle Θ which is variably controlled by the controller 3, with respect to the combination of the first and second modifications. For example, it is assumed for the sake of convenience that a pressing force of 135 kg is required when the recording paper 11 is a thick paper, and a pressing force of 55 kg is required when the recording paper 11 is a thin paper. In addition, it is also assumed that the thickness of the toner layer is approximately 40 μm when the amount of toner adhered on the recording paper 11 is large, and the thickness of the toner layer is approximately 10 μm when the amount of toner adhered on the recording paper 11 is small. Further, for the sake of convenience, it is assumed that the pressing roller 32 does not have a heating means or that the heating quantity of the pressing roller 32 is constant.

Next, a description will be given of a third embodiment of the image forming apparatus according to the present invention. If there is a restriction on the heating quantity of each heating means of the rollers within the fixing unit that is used, there is a restriction on the outer diameter of the rollers within the fixing unit, a specific recording paper is used or, a multi-color printing is to be carried out, it may not be possible to obtain a sufficient fixing energy that is required in the fixing unit. Hence, this embodiment supplements the insufficient fixing energy of the fixing unit by providing a preheating unit on the upstream side of the fixing unit in the transport direction of the recording paper.

Figure 15:
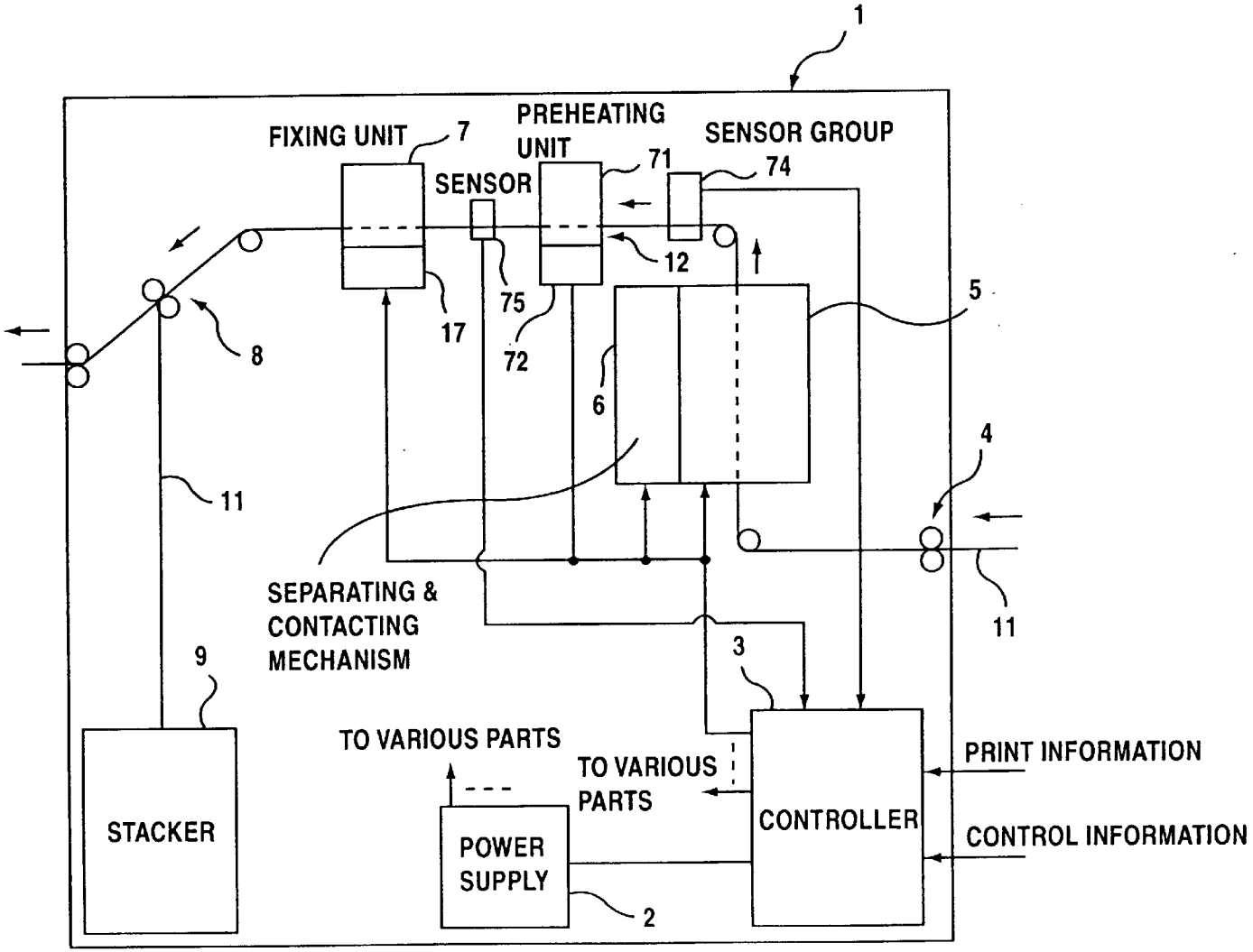
FIG. 15 is a diagram showing the general construction of a third embodiment of the image forming apparatus according to the present invention.

FIG. 15 is a diagram showing the general construction of the third embodiment of the image forming apparatus. In FIG. 15, those parts which are the same as those corresponding parts in FIG. 1 are designated by the same reference numerals, and a description thereof will be omitted.

As shown in FIG. 15, this embodiment is provided with a preheating unit 71 on the upstream side of the fixing unit 7 in the transport direction of the recording paper 11, and a third separating and contacting mechanism 72 is provided with respect to this preheating unit 71. The preheating unit 71 and the third separating and contacting mechanism 72 are also controlled by the controller 3, similarly to the fixing unit 7 and the second separating and contacting mechanism 17. In addition, a sensor group 74 is provided on the upstream side of the preheating unit 71 in the transport direction of the recording paper 11, and a sensor 75 is provided on the upstream side of the fixing unit 7 in the transport direction of the recording paper 11. Output signals of the sensor group 74 and the sensor 75, are supplied to the controller 3.

The preheating unit 71 may be made of a pair of preheating rollers which are arranged similarly to the conventional fixing unit, so that an imaginary line connecting center axes of the preheating rollers is approximately perpendicular to the surface of the recording paper 11. However, the fixing efficiency is improved by wrapping the recording paper 11 around the preheating rollers for the wrap-around angle Θ, as described above in conjunction with the embodiments. Hence, for the sake of convenience, it is assumed in this embodiment that the recording paper 11 also wraps around the preheating rollers for the wrap-around angle Θ in the preheating unit 71.

Figure 16:
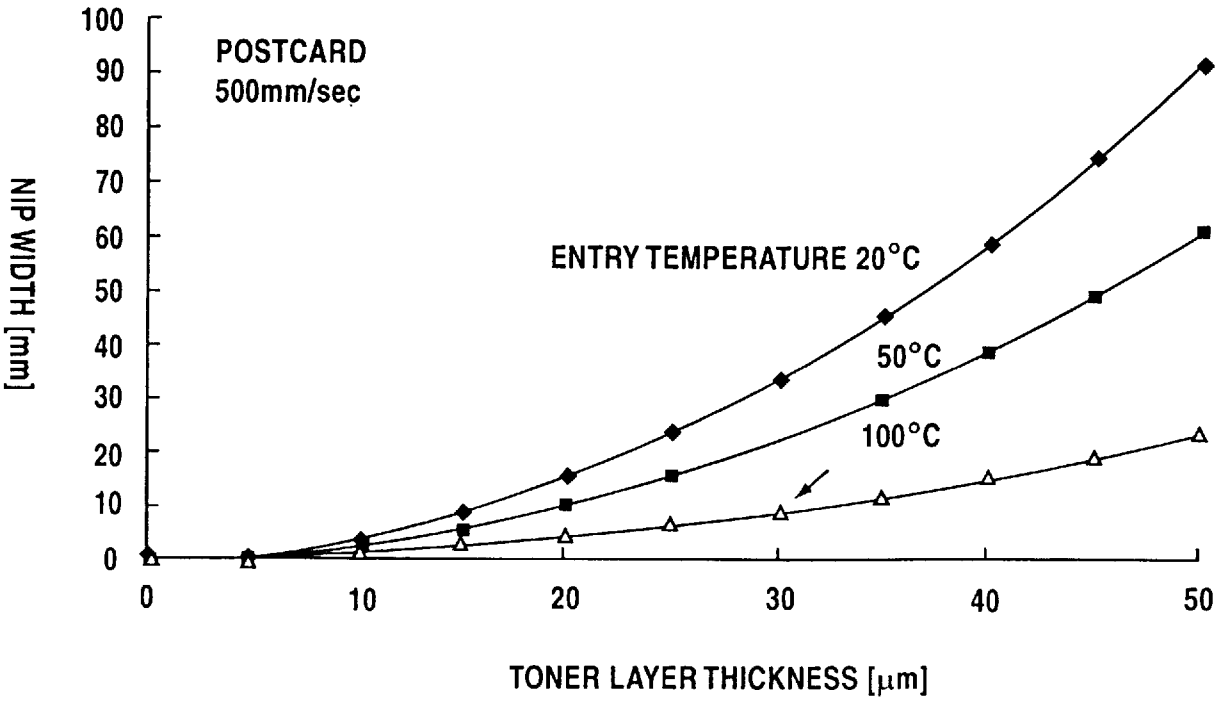
FIG. 16 is a diagram showing the relationship of an entry temperature of a recording paper supplied to the fixing unit and a nip width.

FIG. 16 is a diagram showing the relationship of the entry temperature of the recording paper 11 supplied to the fixing unit 7 and the nip width which are required in order to carry out a satisfactory fixing in the fixing unit 7, for a case where the outer diameters of the rollers 31 and 32 used in the fixing unit 7 is 80 mm or less and the nip width that is obtained is limited. It is assumed in this case that the recording paper 11 is a postcard having a thickness of 0.19 mm, the transport speed of the recording paper 11 is 500 mm/sec, and a duplex printing is carried out with respect to the entire surfaces of the recording paper 11 so that the thickness of the toner layer adhered on each side of the recording paper 11 is 15 μm and the total toner layer thickness is 30 μm.

As indicated by an arrow in FIG. 16, when the nip width in the fixing unit 7 is limited to 8.8 mm, for example, the entry temperature of the recording paper 11 supplied to the fixing unit 7 should be 100° C.

Figure 17:
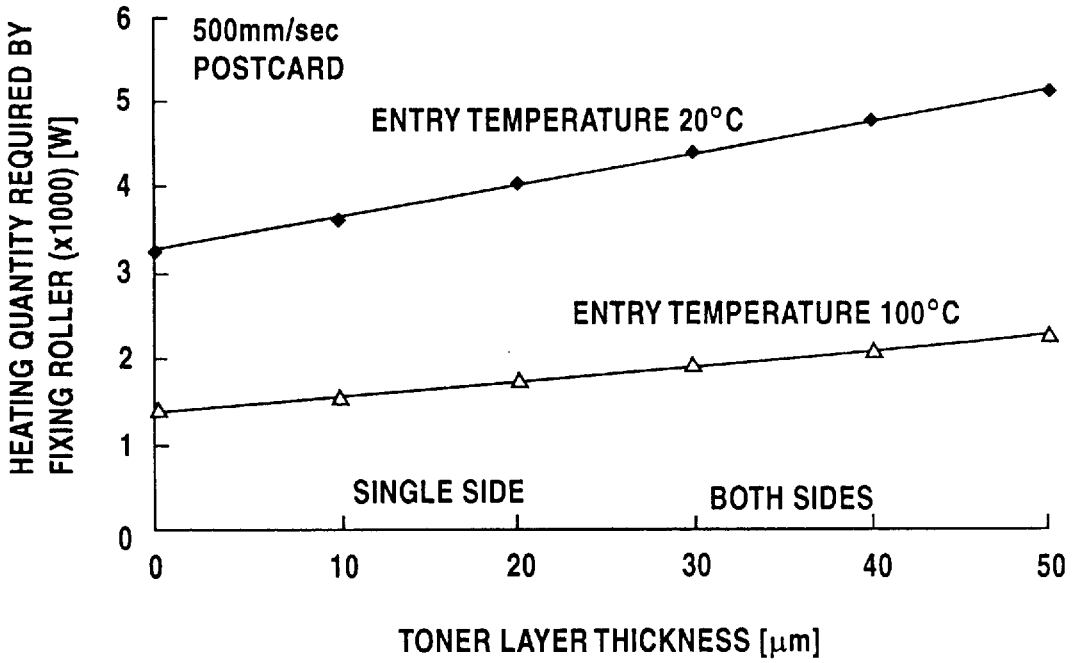
FIG. 17 is a diagram showing the relationship of a total toner layer thickness on the recording paper and a heating quantity required in a fixing roller of the fixing unit.

FIG. 17 is a diagram showing the relationship of the total toner layer thickness on the recording paper 11 and the required heating quantity of the fixing roller 31 of the fixing unit 7. In this case, it is assumed that no heating means is provided in the pressing roller 32. A case where the entry temperature of the recording paper 11 supplied to the fixing unit 7 is 20° C. corresponds to the case where no preheating unit 71 is provided.

As may be seen from FIG. 17, when the duplex printing is carried out with respect to the entire surfaces of the postcard under the above described conditions, the heating quantity required in the fixing unit 7 becomes approximately 2000 W if the recording paper 11 is preheated by the preheating unit 71 so that the entry temperature of the recording paper 11 becomes 100° C. on the other hand, if no preheating unit 71 is provided and the entry temperature of the recording paper 11 is 20° C., the heating quantity required in the fixing unit 7 is approximately 4300 W. Accordingly, it is possible to reduce the heating quantity required in the fixing unit 7 to approximately one-half by providing the preheating unit 71. As a result, it may be seen that the provision of the preheating unit 71 is extremely effective when the heating quantity obtainable in the fixing unit 7 is limited due to the unit size or the like, and when the serviceable life of the fixing unit 7 is to be extended by preventing deterioration of the rollers 31 and 32 caused by the large heating quantity generated within the fixing unit 7.

Figure 18:
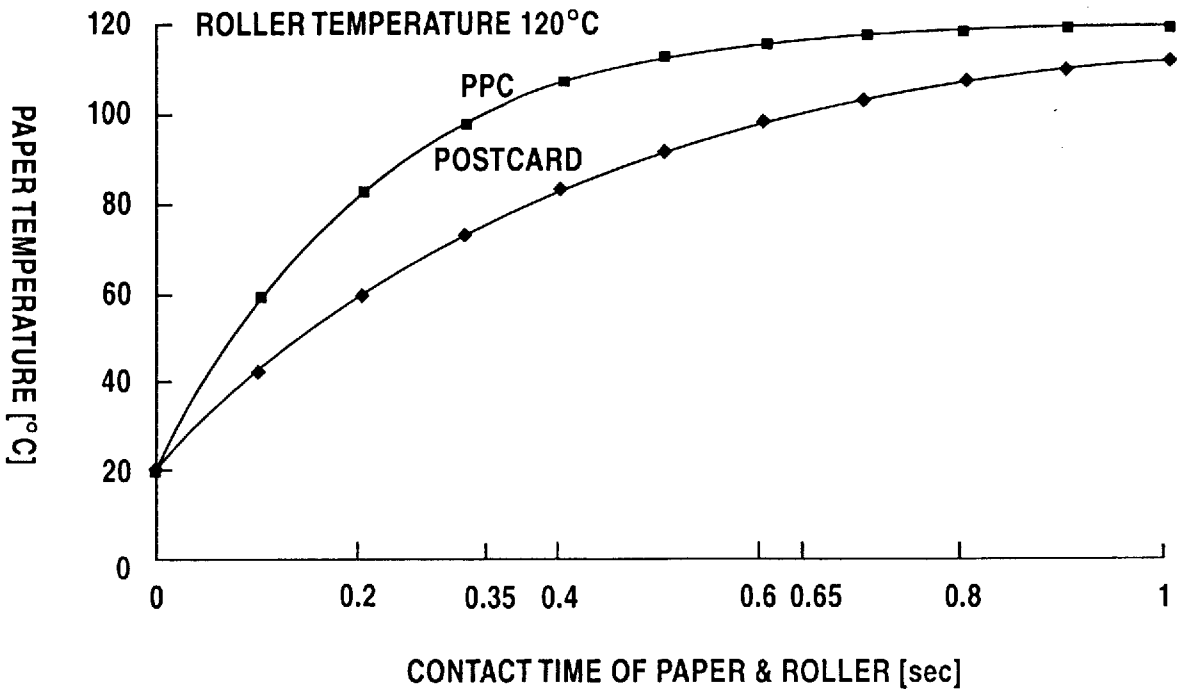
FIG. 18 is a diagram showing the required contact time of preheating rollers of a preheating unit which are heated to 120° C. with respect to the recording paper in order to make the entry temperature of the recording paper supplied to the fixing unit 100° C.

FIG. 18 is a diagram showing the required contact time of the preheating rollers of the preheating unit 71 which are heated to 120° C. with respect to the recording paper 11 in order to make the entry temperature of the recording paper 11 supplied to the fixing unit 7 100° C.

As may be seen from FIG. 18, the required contact time is 0.35 sec when the recording paper 11 is a paper for plain paper copy (hereinafter simply referred to as PPC paper) having a thickness of 0.09 mm, and is 0.65 sec when the recording paper 11 is a postcard having a thickness of 0.19 mm.

If the number of preheating rollers provided within the preheating unit 71 is denoted by n, the wrap-around angle of the recording paper 11 per preheating roller is denoted by Θ1°, the outer diameter of the preheating roller is denoted by d mm, and the transport speed of the recording paper 11 is denoted by v mm/sec, the above required contact time can be described by $t=n\cdot(\Theta 1/360)\cdot(\pi\cdot d/v)$ sec. In the case where n=4, d=80 mm, and v=500 mm/sec, the wrap-around angle Θ1 becomes 63° for the PPC paper and becomes 116° for the postcard. Accordingly, by controlling the wrap-around angle Θ1 of the recording paper 11 with respect to the preheating rollers of the preheating unit 71, it is possible to stably control the entry temperature of the recording paper 11 supplied to the fixing unit 7 to 100° C., for example. The control itself of the wrap-around angle Θ1 may be made similarly to the control of the wrap-around angle Θ in the fixing unit 7 described above.

The amount of toner forming the toner image which is transferred onto the recording paper 11 depends on the image that is printed, and the rate of the temperature rise of the recording paper 11 at the time of the toner image transfer is not constant. For this reason, strictly speaking, the entry temperature of the recording paper 11 supplied to the fixing unit 7 constantly changes. Such a change in the entry temperature also occurs due to a temperature change in the recording paper 11 on the upstream side of the preheating unit 71 in the transport direction of the recording paper 11, and due to moisture (water content) included in the recording paper 11.

Accordingly, this embodiment detects the entry temperature of the recording paper 11 by the sensor 75 which is provided on the upstream side of the fixing unit and on the downstream side of the preheating unit 71 in the transport direction of the recording paper 11. Because the output signal of the sensor 75 is supplied to the controller 3, the controller 3 automatically controls the wrap-around angle Θ1 in the preheating unit 71 based on the detected entry temperature. For example, the controller 3 automatically outputs a control signal for controlling the third separating and contacting mechanism 72 to increase the wrap-around angle Θ1 if the detected entry temperature is lower than 100° C., and for controlling the third separating and contacting mechanism 72 to reduce the wrap-around angle Θ1 if the detected entry temperature is higher than 100° C. Consequently, the entry temperature of the recording paper 11 supplied to the fixing unit 7 is always maintained constant, and it is possible to carry out a satisfactory image printing such that the fixing characteristic and luster of the fixed image do not change.

Next, a description will be given of a first modification of the third embodiment. In this modification, the wrap-around angle Θ1 of the recording paper 11 with respect to the preheating rollers of the preheating unit 71 is maintained constant, and the heating quantity of the preheating rollers, that is, the preheating temperature, is controlled depending on the thickness, characteristic and the like of the recording paper 11.

In this case, the sensor group 74 includes sensors such as the sensor 10 used in the second embodiment described above. Hence, the controller 3 can recognize the thickness, characteristic and the like of the recording paper 11 based on the output signal of the sensor 10 included in the sensor group 74. In addition, the controller 3 controls the temperature of the preheating rollers within the preheating unit 71 based on the recognized thickness, characteristic and the like of the recording paper 11.

Figure 19:
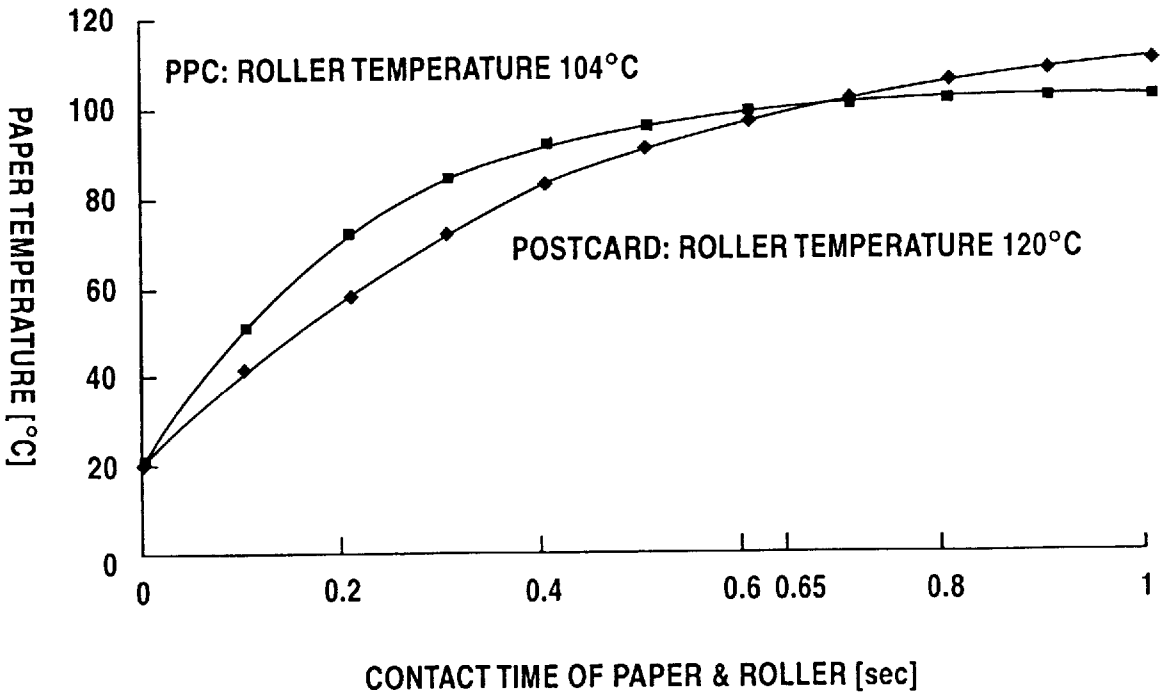
FIG. 19 is a diagram showing the relationship of the temperature of the recording paper and the contact time of the preheating rollers under conditions similar to those in the case of the third embodiment.

FIG. 19 is a diagram showing the relationship of the temperature of the recording paper 11 and the contact time of the recording paper 11 and the preheating rollers, under the same conditions described above with respect to the third embodiment. If it is assumed for the sake of convenience that the wrap-around angle Θ1 of the recording paper 11 with respect to the preheating rollers is 116° and the contact time is 0.64 sec, the controller 3 controls the temperature of the preheating rollers to 104° C. when the PPC paper is detected and controls the temperature of the preheating rollers to 120° C. when the postcard is detected.

Next, a description will be given of a second modification of the third embodiment. In this modification, the wrap-around angle Θ1 of the recording paper 11 with respect to the preheating rollers in the preheating unit 71 is corrected depending on the temperature of the recording paper 11 on the upstream side of the preheating unit 71 in the transport direction of the recording paper 11.

In this case, the sensor group 74 includes a radiation temperature sensor in addition to the sensor 10 described above. Hence, the controller 3 can recognize the thickness of the recording paper 11 and the temperature of the recording paper 11 on the upstream side of the preheating unit 71 based on the output signal of the sensor 10 and the output signal of the radiation temperature sensor included in the sensor group 74. In addition, the controller 3 corrects the wrap-around angle Θ1 in the preheating unit 71 based on the recognized thickness and temperature of the recording paper 11.

The following Table 1 shows the relationship of the temperature of the recording paper 11 on the upstream side of the preheating unit 71 in the transport direction of the recording paper 11 and the correction quantity of the wrap-around angle Θ1, with respect to cases where the post card and the PPC paper are used as the recording paper 11. For example, a ROM table indicating such a relationship is stored in a memory of the controller 3, and the controller 3 corrects the wrap-around angle Θ1 in the preheating unit 71 by referring to the ROM table.

TABLE 1

| | | | | |
|---|---|---|---|---|
| Paper Temperature (°C.) | 10 | 20 | 30 | 40 |
| Correction Quantity (°) For PPC Paper | 0 | 0 | −10 | −10 |
| Correction Quantity (°) For Postcard | 0 | 0 | −20 | −20 |

Next, a description will be given of a third modification of the third embodiment. In this modification, the wrap-around angle Θ1 of the recording paper 11 with respect to the preheating rollers of the preheating unit 71 is corrected depending on the water content of the recording paper 11 on the upstream side of the preheating unit 71 in the transport direction of the recording paper 11.

In this case, the sensor group 74 includes a water content sensor in addition to the sensor 10 described above. Hence, the controller 3 can recognize the thickness of the recording paper 11 and the water content of the recording paper 11 on the upstream side of the preheating unit 71 in the transport direction of the recording paper 11, based on the output signal of the sensor 10 and an output signal of the water content sensor included in the sensor group 74. In addition, the controller 3 corrects the wrap-around angle Θ1 in the preheating unit 71 based on the recognized thickness and water content of the recording paper 11.

The following Table 2 shows the relationship of the water content of the recording paper 11 on the upstream side of the preheating unit 71 in the transport direction of the recording paper 11 and the correction quantity of the wrap-around angle Θ1, with respect to cases where the post card and the PPC paper are used as the recording paper 11. For example, a ROM table indicating such a relationship is stored in a memory of the controller 3, and the controller 3 corrects the wrap-around angle Θ1 in the preheating unit 71 by referring to the ROM table.

TABLE 2

| | | | | |
|---|---|---|---|---|
| Water Content of Paper (%) | 2 | 4 | 6 | 8 |
| Correction Quantity (°) For PPC Paper | −6 | −3 | +3 | +6 |
| Correction Quantity (°) For Postcard | −12 | −6 | +6 | +12 |

Next, a description will be given of a fourth modification of the third embodiment. In this modification, the wrap-around angle Θ1 of the recording paper 11 with respect to the preheating rollers of the preheating unit 71 is corrected depending on the amount of toner adhered on the recording paper 11 on the upstream side of the preheating unit 71 in the transport direction of the recording paper 11.

In this case, the sensor group 74 includes the sensor 10 which detects the amount of toner adhered on the recording paper 11. Hence, the controller 3 can recognize the amount of toner adhered on the recording paper 11 on the upstream side of the preheating unit 71 in the transport direction of the recording paper 11, based on the output signal of the sensor 10 included in the sensor group 74. In addition, the controller 3 corrects the wrap-around angle Θ1 in the preheating unit 71 based on the recognized amount of toner adhered on the recording paper 11.

The amount of toner adhered on the recording paper 11 is proportional to a dot rate of print data per unit area. For this reason, the controller 3 may be constructed to calculate the amount of toner adhered on the recording paper 11 from the dot rate, based on input print information. In this case, the sensor 10 for detecting the amount of toner adhered on the recording paper 11 can be omitted.

The following Table 3 shows the relationship of the amount of toner adhered (dot rate) on the recording paper 11 on the upstream side of the preheating unit 71 in the transport direction of the recording paper 11 and the correction quantity of the wrap-around angle Θ1. For example, a ROM table indicating such a relationship is stored in a memory of the controller 3, and the controller 3 corrects the wrap-around angle Θ1 in the preheating unit 71 by referring to the ROM table.

TABLE 3

| Amount of Toner Adhered (%) | ≦60 | 70 | 80 | 90 | 100 |
|---|---|---|---|---|---|
| Correction Quantity (°) | −30 | −24 | −18 | −10 | 0 |

Figure 20:
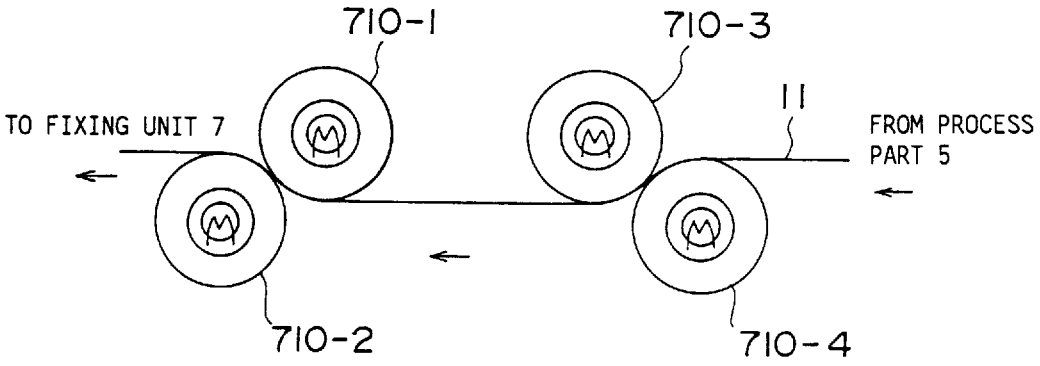
FIG. 20 is a diagram showing a case where four preheating rollers form the preheating unit in the third embodiment and first through fourth modifications of the third embodiment.

FIG. 20 is a diagram showing a case where the preheating unit 71 of the third embodiment and first through fourth modifications of the third embodiment is made up of four preheating rollers 710-1 through 710-4. In this case, an imaginary line connecting rotary axes of the pair of preheating rollers 710-1 and 710-2 and an imaginary line connecting rotary axes of the pair of preheating rollers 710-3 and 710-4 are tilted in mutually opposite directions with respect to the transport direction of the recording paper 11 (horizontal direction in FIG. 20).

As a method of controlling the heating quantity of the preheating unit 71, it is possible to put one of the two pairs-or both the two pairs of preheating rollers in the contact state with respect to the recording paper 11.

Figure 21:
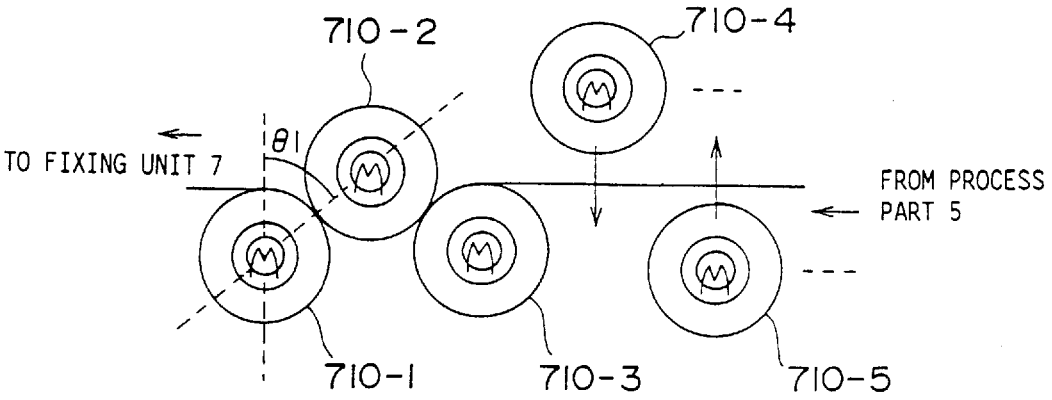
FIG. 21 is a diagram showing a case where N preheating rollers form the preheating unit in the third embodiment and the first through fourth modifications of the third embodiment.

FIG. 21 is a diagram showing a case where the preheating unit 71 is made up of N preheating rollers 710-1 through 710-N in the third embodiment and the first through fourth modifications of the third embodiment described above. In this case, it is possible to control the heating quantity of the preheating unit 71 by controlling the total wrap-around angle Θ1 in the preheating unit 71 depending on the number of preheating rollers making contact with the recording paper 11.

Further, the present invention is not limited to these embodiments, but various variations and modifications may be made without departing from the scope of the present invention.

What is claimed is:

1. An image forming apparatus comprising:

a fixing unit including at least a pair of rollers which thermally fix a toner image formed on a surface of a recording medium by pressing against the recording medium; and a separating and contacting mechanism supporting said pair of rollers so that the rollers can separate from and make contact with the recording medium, said separating and contacting mechanism controlling the rollers when contacting the rollers to the recording medium, by contacting each of the rollers approximately perpendicularly to the surface of the recording medium and so that the recording medium thereafter makes contact with a surface of each of the rollers for a wrap-around angle greater than 0°, wherein said separating and contacting mechanism includes a tilting mechanism which controls each of the rollers when contacting the rollers to the recording medium, by contacting each of the rollers approximately perpendicularly to the surface of the recording medium and thereafter tilting at least one of the rollers so that an imaginary line connecting rotary axes of the pair of rollers tilts from a position where the imaginary line is approximately perpendicular to the surface of the recording medium.

2. The image forming apparatus as claimed in claim 1, wherein said tilting mechanism tilts said at least one roller about a contact point where the at least one roller contacts with the recording medium approximately perpendicularly to the surface of the recording medium.

3. The image forming apparatus as claimed in claim 1, wherein at least one of said pair of rollers comprises a semi-soft roller.

4. The image forming apparatus as claimed in claim 1, which further comprises:

varying means for variably setting said wrap-around angle.

5. The image forming apparatus as claimed in claim 4, wherein said varying means variably sets said wrap-around angle depending on at least one of conditions selected from a group consisting of a thickness of the recording medium, a characteristic of the recording medium, a kind of toner forming the toner image, and an amount of toner adhered on the surface of the recording medium and forming the toner image.

6. The image forming apparatus as claimed in claim 1, which further comprises:

control means for variably controlling a heating quantity of at least one of said pair of rollers depending on at least one of conditions selected from a group consisting of a thickness of the recording medium, a characteristic of the recording medium, a kind of toner forming the toner image, and an amount of toner adhered on the surface of the recording medium and forming the toner image.

7. The image forming apparatus as claimed in claim 1, which further comprises:

preheating means for preheating the recording medium, having the toner image thereon, at a stage preceding said fixing unit.

8. The image forming apparatus as claimed in claim 7, wherein said preheating means comprises a pair of preheating rollers, said recording medium making contact with surfaces of the preheating rollers for a wrap-around angle greater than 0°.

9. The image forming apparatus as claimed in claim 8, which further comprises:

varying means for variably setting the wrap-around angle of the recording medium with respect to the preheating rollers.

10. The image-forming apparatus as claimed in claim 9, which further comprises:

temperature detection means for detecting a temperature of the recording medium supplied to said fixing unit, said varying means variably setting the wrap-around angle of the recording medium with respect to the preheating rollers depending on the temperature detected by said temperature detection means.

11. The image forming apparatus as claimed in claim 8, which further comprises:

control means for variably controlling a heating quantity of at least one of the preheating rollers.

12. The image forming apparatus as claimed in claim 11, which further comprises:

a temperature detection means for detecting a temperature of the recording medium supplied to said fixing unit, said control means variably controlling a heating quantity of at least one of the preheating rollers depending on the temperature detected by said temperature detection means.

13. The image forming apparatus as claimed in claim 8, which further comprises:

detecting means for detecting one of a characteristic of the recording medium, an amount of toner adhered on the recording medium, and a temperature of the recording medium, at a stage preceding said preheating means; and correcting means for correcting the wrap-around angle of the recording medium with respect to the preheating rollers based on said one of the characteristic of the recording medium, the amount of toner adhered on the recording medium, and the temperature of the recording medium detected by said detecting means.

14. An image forming apparatus comprising:

a fixing unit including at least a pair of rollers which thermally fix a toner image formed on a surface of a recording medium by pressing against the recording medium;

a separating and contacting mechanism supporting said pair of rollers so that the rollers can separate from and make contact with the recording medium; and preheating means for preheating the recording medium which is transferred with the toner image at a stage preceding said fixing unit, said separating and contacting mechanism controlling the rollers when contacting the rollers to the recording medium, by contacting each of the rollers approximately perpendicularly to the surface of the recording medium and so that the recording medium thereafter makes contact with a surface of each of the rollers for a wrap-around angle greater than 0°, wherein said preheating means comprises a pair of preheating rollers, said recording medium making contact with surfaces of the preheating rollers for a wrap-around angle greater than 0°.

* * * * *